US009355589B2

(12) United States Patent
Lu et al.

(10) Patent No.: US 9,355,589 B2
(45) Date of Patent: May 31, 2016

(54) LED DISPLAY

(71) Applicant: LEYARD OPTOELECTRONIC CO., LTD., Beijing (CN)

(72) Inventors: Changjun Lu, Beijing (CN); Zhiyong Liu, Beijing (CN)

(73) Assignee: LEYARD OPTOELECTRONIC CO., LTD., Beijing (CN)

( * ) Notice: Subject to any disclaimer, the term of this patent is extended or adjusted under 35 U.S.C. 154(b) by 0 days.

(21) Appl. No.: 14/648,239

(22) PCT Filed: May 31, 2013

(86) PCT No.: PCT/CN2013/076609

§ 371 (c)(1),
(2) Date: May 28, 2015

(87) PCT Pub. No.: WO2014/082435

PCT Pub. Date: Jun. 5, 2014

(65) Prior Publication Data

US 2015/0302792 A1 Oct. 22, 2015

(30) Foreign Application Priority Data

Nov. 29, 2012 (CN) ..... 2012 1 050197

(51) Int. Cl.
*G09G 3/32* (2006.01)

(52) U.S. Cl.
CPC ..... *G09G 3/32* (2013.01); *G09G 2300/0452* (2013.01); *G09G 2310/0264* (2013.01);
(Continued)

(58) Field of Classification Search
USPC ..... 315/169.3, 185 R, 192, 291, 294; 345/52, 83, 90, 204, 211, 212
See application file for complete search history.

(56) References Cited

U.S. PATENT DOCUMENTS 7,088,321 B1 * 8/2006 Parker ..... G09G 3/3406 345/211
2006/0208984 A1 * 9/2006 Kim ..... G09G 3/3648 345/90

(Continued)

FOREIGN PATENT DOCUMENTS

CN 101707031 A 5/2010
CN 101840657 A 9/2010

(Continued)

OTHER PUBLICATIONS

International Search Report for PCT International Application No. PCT/CN2013/076609, mailed Sep. 12, 2013.

*Primary Examiner* — Thai Pham
(74) *Attorney, Agent, or Firm* — Pearl Cohen Zedek Latzer Baratz LLP

(57) ABSTRACT

A Light-Emitting Diode (LED) display includes: an LED display panel; and a display driving circuit, including a switching circuit and a control circuit, wherein the switching circuit comprises first and second switching sub-circuits; the first switching sub-circuit includes one or more field effect transistors; the second switching sub-circuit includes one or more field effect transistors; the control circuit includes a power supply control circuit connected with a third end of the switching circuit through a power supply control port. The switching circuit and the control circuit are integrated in the display driving circuit, and the two switching sub-circuits control the power supply of R/G/B LEDs in an LED particle array with M lines and N columns in the LED display panel respectively, so that the effects of small PCB area occupied by the control circuit, simple design, high refresh rate and low power consumption of the LED display are achieved.

14 Claims, 26 Drawing Sheets

(52) U.S. Cl.
CPC .. *G09G2310/0278* (2013.01); *G09G 2310/061* (2013.01); *G09G 2330/021* (2013.01); *G09G 2330/028* (2013.01)

(56) References Cited

U.S. PATENT DOCUMENTS

2007/0001943 A1* 1/2007 Lee ..... G09G 3/14
345/83
2012/0127143 A1* 5/2012 Gondo ..... G09G 3/3648
345/208
2012/0229036 A1 9/2012 Takahashi et al.

FOREIGN PATENT DOCUMENTS

CN 203086778 U 7/2013
KR 20120076966 A 7/2012

* cited by examiner

LED DISPLAY

CROSS-REFERENCE TO RELATED APPLICATIONS

This application is a National Phase Application of PCT International Application No. PCT/CN2013/076609, International Filing Date May 31, 2013, claiming priority of Chinese Patent Application No. 201210501971.5, filed Nov. 29, 2012, which is hereby incorporated by reference.

FIELD OF THE INVENTION

The disclosure relates to the field of Light-Emitting Diode (LED) equipment, in particular to an LED display.

BACKGROUND OF THE INVENTION

At present, a split placement mode is adopted for LEDs, P-channel Metal Oxide Semiconductor (P-MOS) transistors and an LED driving circuit during the design of a unit board of an LED display. As shown in FIG. 1*b*: LED particles in FIG. 1*b* are four-pin Red/Green/Blue (R/G/B) common-anode three-in-one LEDs, pins 1 are common anodes, and pins 2/3/4 are cathodes of the R/G/B LEDs respectively; and one of control ports of an external display driving circuit 30' is a constant current control signal output port, the other of the control ports is a line power supply control port, and the constant current control signal output port is matched with the line power supply control port to realize the display work of an LED array.

FIG. 1*a* to FIG. 1*c* are split placement diagrams of an LED driving circuit for common-anode three-in-one LED particles in related art. As shown in FIG. 1*a*, the LED driving circuit includes three logic circuits and corresponding constant current channel groups, i.e. LED driving control circuits for controlling R/G/B display in the LED unit board respectively, and the three integrated circuits have the same internal architecture, and drive the display of the LED array under the control of the external display driving circuit 30'. A current LED driving circuit includes multiple independent constant current logic components forming a constant current array; each constant current logic component consists of a constant current input end, a constant current output end and a constant current control end, the constant output ends of the constant current array are connected with an external pin GND of the LED driving circuit; the constant current array is controlled by the internal logic circuits of the LED driving circuit in a unified way to realize the ordered work of each independent constant current logic component and control the display of external LEDs; each internal logic circuit also includes two parts, i.e. an LED driving circuit input signal port and an output signal port, wherein the input signal ports are connected to the constant current control signal output port of the external display driving circuit 30', and the output signal ports are used for cascading input signal ports of an LED driving circuit of the next stage or are idled; and P-MOS components shown in FIG. 1*a* are controlled by the line power supply control port to realize line-by-line power supply control over the LED array.

The LED unit board consists of an LED matrix with M lines and N columns, anodes of the LEDs in a single line are interconnected to drains of the P-MOS transistors, and a common cathode of basic colors of the LEDs in a single column is interconnected to a constant current input end of the corresponding LED driving control circuit; sources of the P-MOS transistors are connected to a power supply end VCC, and gates of the P-MOS transistors are connected to the line power supply control port; and under the control of the display driving circuit 30', the drain of a certain P-MOS transistor is switched on to supply power to the anodes of the LEDs in the corresponding line, the constant current control signal output port controls the logic circuits of the LED driving circuit to control the ordered conduction of the constant current array and realize the ordered conduction of the current of the LEDs in the line to GND to realize the ordered switching-on of the LEDs.

From the above, the P-MOS transistors, the LED driving circuit and the display driving circuit 30' are independently encapsulated electronic components, and a Printed Circuit Board (PCB) area occupied by the P-MOS transistors, the LED driving circuit and the display driving circuit 30' for the LED array display of a certain resolution under the conditions of a certain scanning mode and a certain P-MOS transistor load is a fixed value, that is, the PCB area occupied by the components is a fixed value, which inevitably brings the problems of low refresh rate and high design difficulty during application to a control mode of a high-density LED display.

In addition, FIG. 2*a* to FIG. 2*c* are split placement circuit diagrams of an LED driving circuit for 6-pin R/G/B three-in-one LEDs in related art. Wherein, an anode of each 6-pin R/G/B three-in-one LED in FIG. 2*b* has three pins, i.e. 1, 2 and 3 respectively, corresponding to internal R/G/B anodes respectively, and a cathode of each 6-pin R/G/B three-in-one LED has three pins, i.e. 4, 5 and 6 respectively, corresponding to internal R/G/B cathodes respectively; the LED unit board consists of an LED matrix with M lines and N columns, the anodes of the LEDs in each line are interconnected to the drains of the P-MOS transistors, and a common basic color cathode of the LEDs in each column is interconnected to the input end of the LED driving circuit; the sources of the P-MOS transistors are connected to the power supply end VCC, the gates of the P-MOS transistors are connected to a power supply control logic part of the display driving circuit 30', and the drains of the P-MOS transistors are the anodes of a group of LEDs (LEDs in a single line in FIG. 2*b*, the group is not purely defined into a line actually) connected to the LED unit board; the control end of the LED driving circuit is connected with a branch of an LED driving circuit control part, and driving current for switching on the LEDs flows through the input end of the LED driving circuit and the output ends of the LED driving control circuits to reach the GND from the cathodes (pins 4, 5 and 6) of the LEDs; and the display driving circuit 30' includes a line power supply control logic part and the LED driving circuit control part, and under the control of the display driving circuit 30', the display work of the LED unit board is realized.

FIG. 3*a* to FIG. 3*c* are split placement circuit diagrams of an LED driving circuit for R/G/B independent LEDs in related art. As shown in FIG. 3*b*, an anode of an R/G/B independent LED particle is pin 1, a cathode of the R/G/B independent LED particle is pin 2, and R/G/B are welded in parallel to form a full-color pixel during application; the LED unit board consists of an LED matrix with M lines and N columns, the anodes of the LEDs in each line are interconnected to the drains of the P-MOS transistors, and the common basic color cathode of the LEDs in each column is interconnected to the input end of the LED driving circuit; the sources of the P-MOS transistors are connected to the power supply end VCC, the gates of the P-MOS transistors are connected to the power supply control logic part of the display driving circuit 30', and the drains of the P-MOS transistors are connected to the anodes of a group of LEDs (LEDs in a single line in FIG. 3*b*, the group is not purely defined into a line actually) of the LED unit board; the control end of the LED driving circuit is connected with a branch of an LED driving circuit control part, and the driving current for switching on the LEDs flows through the input end of the LED driving circuit and the output ends of the LED driving control circuits to reach the GND from the cathodes (pins 2) of the LED particles; and the display driving circuit 30' includes a line power supply control logic part and the LED driving circuit control part, and under the control of the display driving circuit 30', the display work of the LED unit board is realized.

From the above, the R/G/B LEDs have different working voltages, wherein a typical working voltage of R LEDs is 1.8-2V, and typical working voltages of G/B LEDs are 3.4-3.6V, so that output voltages of the P-MOS transistors must be higher than the sum of the typical voltages of the G/B LEDs and a typical constant current voltage of the LED driving circuit to ensure that working voltages of the G/B LEDs are normal. Thus, voltage differences of the R LEDs relative to the G/B LEDs are applied to the LED driving circuit to generate heat for dissipation, which causes high power consumption of the LED display.

For the problems of large PCB area occupied by the control circuits, low refresh rate and high power consumption of the LED display in related art, there is yet no effective solution.

SUMMARY OF THE INVENTION

For the problems of large PCB area occupied by a control circuit, low refresh rate and high power consumption of an LED display in a related art, there is yet no effective solution. Therefore, a main purpose of the disclosure is to provide an LED display, so as to solve the problems.

In order to achieve the purpose, according to one aspect of the disclosure, an LED display is provided, which includes: an LED display panel, and a display driving circuit, includes: a switching circuit and a control circuit, wherein the switching circuit includes a first switching sub-circuit and a second switching sub-circuit; the first switching sub-circuit includes one or more field effect transistors, a source of each field effect transistor is connected with a power end of first power supply equipment, a drain of each field effect transistor is connected with an anode of an R lamp tube in each LED particle in a corresponding line in the LED display panel, and a gate of each field effect transistor is connected with a corresponding connection terminal in a power supply control port, and is configured to control the power supply of the corresponding R lamp tube of the LED display panel; the second switching sub-circuit includes one or more field effect transistors, a source of each field effect transistor is connected with a power end of second power supply equipment, a drain of each field effect transistor is connected with anodes of G/B lamp tubes in each LED particle in a corresponding line in the LED display panel, and a gate of each field effect transistor is connected with a corresponding connection terminal in the power supply control port, and is configured to control the power supply of the G/B lamp tubes of the LED display panel; the control circuit includes a power supply control circuit; the power supply control circuit is connected with a third end of the switching circuit through the power supply control port, and is configured to control the switching-on or switching-off of the switching circuit; and the switching circuit is configured to control the power supply of the LED display panel.

Furthermore, the power supply control circuit is configured to control each field effect transistor in the first switching sub-circuit to be switched on to supply power to the R lamp tubes in the LED particles in the lines corresponding to the field effect transistors in the first switching sub-circuit in the LED display panel; and the power supply control circuit is further configured to control the field effect transistor corresponding to one field effect transistor in the first switching sub-circuit in the second switching sub-circuit to be switched on to supply power to the G/B lamp tubes in each LED particle in the line corresponding to the field effect transistor in the first switching sub-circuit in the LED display panel.

Furthermore, the display driving circuit further includes: a driving circuit, wherein a first end of the driving circuit is connected to a grounding end of power supply equipment, and a second end of the driving circuit is connected with a cathode of the LED display panel. The control circuit further includes: a driving control circuit, wherein the driving control circuit is connected with a third end of the driving circuit through a driving control port, and is configured to control the switching-on or switching-off of the driving circuit; and the driving circuit is configured to control the ordered display of the LED display panel.

Furthermore, the driving circuit includes a constant current channel group, and the constant current channel group includes one or more constant current logic components, wherein a first end of each constant current logic component is connected with the grounding end of the power supply equipment; a second end of each constant current logic component is connected with cathodes of the LED particles in a corresponding column in the LED display panel; and a third end of each constant current logic component is connected with a corresponding connection terminal in the driving control port.

Furthermore, the driving control circuit is configured to control each constant current logic component in the constant current channel group to be switched on, and each constant current logic component provides a current path for the LED particles in the column corresponding to the constant current logic component in the LED display panel to control the ordered display of the LED particles after being switched on.

Furthermore, the field effect transistors are P-MOS transistors, the LED display panel includes M lines and N columns of LED particles, and each LED particle includes an R lamp tube, a G lamp tube and a B lamp tube, wherein an anode of the R lamp tube in the ith LED particle in each line is connected in parallel with an ith joint, and each joint in each line is connected in parallel, and is connected with the drain of one corresponding P-MOS transistor in the first switching sub-circuit; an anode of the G lamp tube and an anode of the B lamp tube in the jth LED particle in each line are connected in parallel with a jth joint, and each joint in each line is connected in parallel, and is connected with the drain of one corresponding P-MOS transistor in the second switching sub-circuit; a cathode of the R lamp tube of each LED particle in each column is connected in parallel, and is connected with the second end of the corresponding constant current logic component in the constant current channel group; a cathode of the G lamp tube of each LED particle in each column is connected in parallel, and is connected with the second end of the corresponding constant current logic component in the constant current channel group; and a cathode of the B lamp tube of each LED particle in each column is connected in parallel, and is connected with the second end of the corresponding constant current logic component in the constant current channel group.

Furthermore, the field effect transistors are P-MOS transistors, the LED display panel includes M lines and N columns of LED particles, and each LED particle includes an R lamp tube, a G lamp tube and a B lamp tube, wherein the anode of the R lamp tube of each LED particle in each line is connected in parallel, and is connected with the drain of one corresponding P-MOS transistor in the first switching sub-circuit; the anode of the G lamp tube and the anode of the B lamp tube in each LED particle in each line are connected in parallel, and are connected with the drain of one corresponding P-MOS transistor in the second switching sub-circuit; the cathode of the R lamp tube of each LED particle in each column is connected in parallel, and is connected with the second end of the corresponding constant current logic component in the constant current channel group; the cathode of the G lamp tube of each LED particle in each column is connected in parallel, and is connected with the second end of the corresponding constant current logic component in the constant current channel group; and the cathode of the B lamp tube of each LED particle in each column is connected in parallel, and is connected with the second end of the corresponding constant current logic component in the constant current channel group.

Furthermore, the driving circuit includes a first constant current channel group, a second constant current channel group and a third constant current channel group, wherein the first constant current channel group includes one or more constant current logic components, a first end of each constant current logic component is connected with the grounding end of the power supply equipment, a third end of each constant current logic component is connected with a first R display control sub-port of the driving control port, and a second end of each constant current logic component is connected with the cathode of the R lamp tube in each LED particle in the corresponding column in the LED display panel, and is configured to control the display of the R lamp tubes of the LED display panel; the second constant current channel group includes one or more constant current logic components, a first end of each constant current logic component is connected with the grounding end of the power supply equipment, a third end of each constant current logic component is connected with a first G display control sub-port of the driving control port, and a second end of each constant current logic component is connected with the cathode of the G lamp tube in each LED particle in the corresponding column in the LED display panel, and is configured to control the display of the G lamp tubes of the LED display panel; and the third constant current channel group includes one or more constant current logic components, a first end of each constant current logic component is connected with the grounding end of the power supply equipment, a third end of each constant current logic component is connected with a first B display control sub-port of the driving control port, and a second end of each constant current logic component is connected with the cathode of the B lamp tube in each LED particle in the corresponding column in the LED display panel, and is configured to control the display of the B lamp tubes of the LED display panel.

Furthermore, the power supply control circuit is configured to control one field effect transistor in the first switching sub-circuit to be switched on to supply power to the R lamp tubes in the LED particles in the line corresponding to the field effect transistor in the first switching sub-circuit in the LED display panel; the power supply control circuit is further configured to control the field effect transistor corresponding to the switched-on field effect transistor in the first switching sub-circuit in the second switching sub-circuit to be switched on to supply power to the G lamp tubes and the B lamp tubes in the LED particles in the line corresponding to the field effect transistor in the first switching sub-circuit in the LED display panel; the driving control circuit is configured to control each constant current logic component in the first constant current channel group to be switched on through a second R display control sub-port, and each constant current logic component provides a current path for the R lamp tubes in the LED particles in the column corresponding to the constant current logic component in the LED display panel to control the display of the R lamp tubes of the LED particles in the line corresponding to the field effect transistor in the LED display panel after being switched on; the driving control circuit is further configured to control each constant current logic component in the second constant current channel group to be switched on through a second G display control sub-port, and each constant current logic component provides a current path for the G lamp tubes in the LED particles in the column corresponding to the constant current logic component in the LED display panel to control the display of the G lamp tubes of the LED particles in the line corresponding to the field effect transistor in the LED display panel after being switched on; and the driving control circuit is further configured to control each constant current logic component in the third constant current channel group to be switched on through a second B display control sub-port, and each constant current logic component provides a current path for the B lamp tubes in the LED particles in the column corresponding to the constant current logic component in the LED display panel to control the display of the B lamp tubes of the LED particles in the line corresponding to the field effect transistor in the LED display panel after being switched on.

Furthermore, the field effect transistors are P-MOS transistors, the LED display panel includes M lines and N columns of LED particles, and each LED particle includes an R lamp tube, a G lamp tube and a B lamp tube, wherein the anode of the R lamp tube in the ith LED particle in each line is connected in parallel with the ith joint, and each joint in each line is connected in parallel, and is connected with the drain of one corresponding P-MOS transistor in the first switching sub-circuit; the anode of the G lamp tube and the anode of the B lamp tube in the jth LED particle in each line are connected in parallel with the jth joint, and each joint in each line is connected in parallel, and is connected with the drain of one corresponding P-MOS transistor in the second switching sub-circuit; the cathode of the R lamp tube of each LED particle in each column is connected in parallel, and is connected with the second end of the corresponding constant current logic component in the first constant current channel group; the cathode of the G lamp tube of each LED particle in each column is connected in parallel, and is connected with the second end of the corresponding constant current logic component in the second constant current channel group; and the cathode of the B lamp tube of each LED particle in each column is connected in parallel, and is connected with the second end of the corresponding constant current logic component in the third constant current channel group.

Furthermore, the field effect transistors are P-MOS transistors, the LED display panel includes M lines and N columns of LED particles, and each LED particle includes an R lamp tube, a G lamp tube and a B lamp tube, wherein the anode of the R lamp tube in each LED particle in each line is connected in parallel, and is connected with the drain of one corresponding P-MOS transistor in the first switching sub-circuit; the anode of the G lamp tube and the anode of the B lamp tube in each LED particle in each line are connected in parallel, and are connected with the drain of one corresponding P-MOS transistor in the second switching sub-circuit as connection terminals of the anode of the LED display panel; the cathode of the R lamp tube of each LED particle in each column is connected in parallel, and is connected with the second end of the corresponding constant current logic component in the first constant current channel group; the cathode of the G lamp tube of each LED particle in each column is connected in parallel, and is connected with the second end of the corresponding constant current logic component in the second constant current channel group; and the cathode of the B lamp tube of each LED particle in each column is connected in parallel, and is connected with the second end of the corresponding constant current logic component in the third constant current channel group.

Furthermore, the LED particles in the LED display panel include the R lamp tubes, the G lamp tubes and the B lamp tubes, wherein the R lamp tubes, the G lamp tubes and the B lamp tubes are integrated in the LED particles; or, the R lamp tubes, the G lamp tubes and the B lamp tubes are arranged in the LED particles after being independently encapsulated respectively.

According to the LED display, the switching circuit and the control circuit are integrated in the display driving circuit, and then more display driving circuits may be placed under the condition of not changing an area of the LED display panel, so that a number ratio of the LED particles and the display driving circuits on the LED display with a fixed area is reduced, and the refresh rate is increased; moreover, the switching circuit includes the first switching sub-circuit and the second switching sub-circuit, the two switching sub-circuits control the power supply of the R/G/B LEDs in the lines of an LED particle array with M lines and N columns in the LED display panel respectively, and the first power supply equipment and the second power supply equipment provide different working voltages for the two switching sub-circuits to provide different working voltages for the R lamp tubes and the G/B lamp tubes of the LED particles in the LED display panel respectively, so that the power consumption of the LED display may be lowered. The problems of large PCB area occupied by the control circuit and low refresh rate of the LED display in related art are solved, and the effects of small PCB area occupied by the control circuit, simple design, high refresh rate and low power consumption of the LED display are achieved.

BRIEF DESCRIPTION OF THE DRAWINGS

The drawings are described here to provide further understanding of the disclosure, and form a part of the disclosure. The schematic embodiments and description of the disclosure are adopted to explain the disclosure, and do not form improper limits to the disclosure. In the drawings.

DETAILED DESCRIPTION OF THE INVENTION

It should be noted that the embodiments of the disclosure and the characteristics in the embodiments may be combined under the condition of no conflicts. The disclosure is descried below with reference to the drawings and embodiments in detail.

Embodiment 1

Figure 1A:
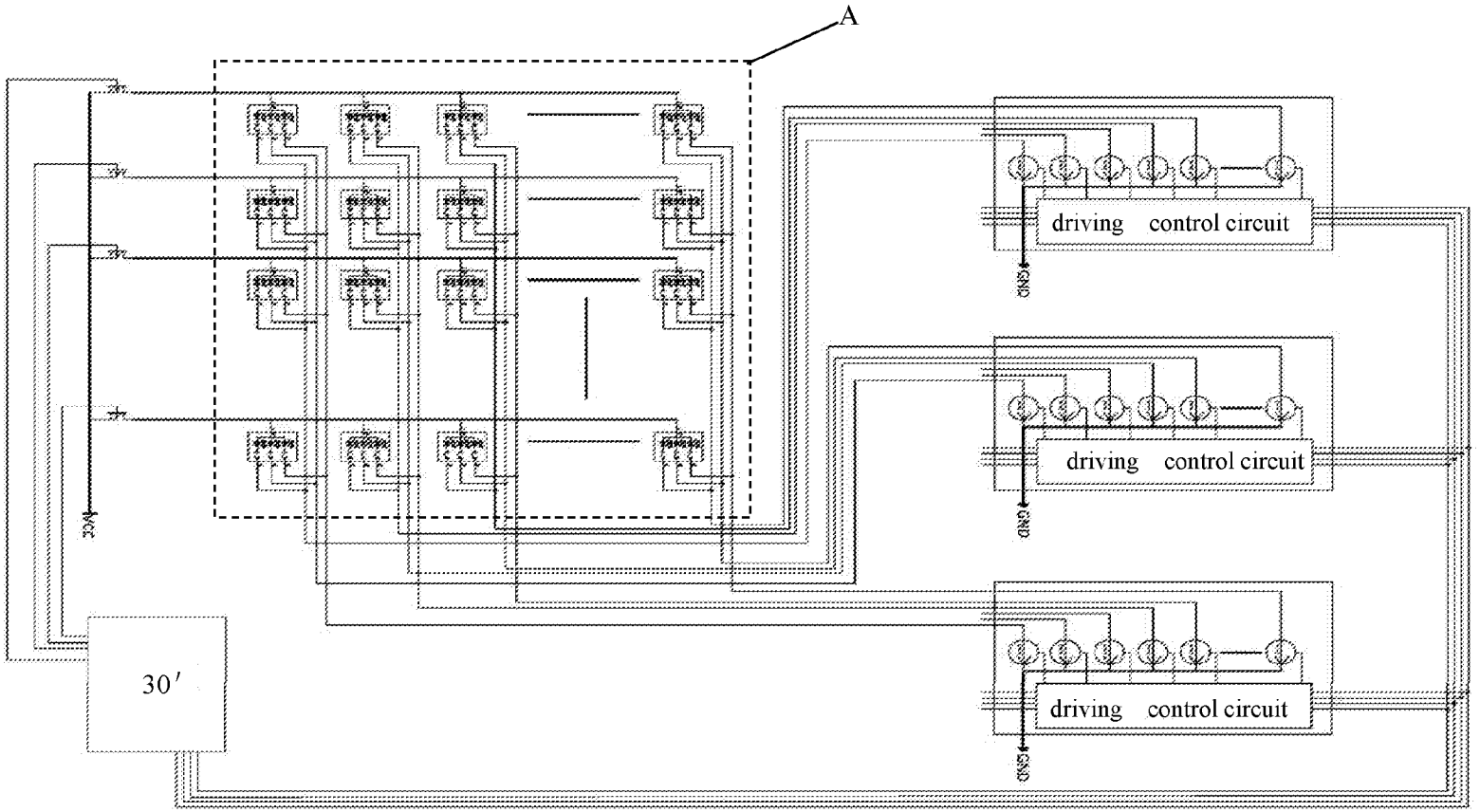
Fig.1a PRIOR ART
FIG. 1*a* is a split placement diagram of an LED driving circuit for three-anode-in-one LED particles in related art.
Figure 1B:
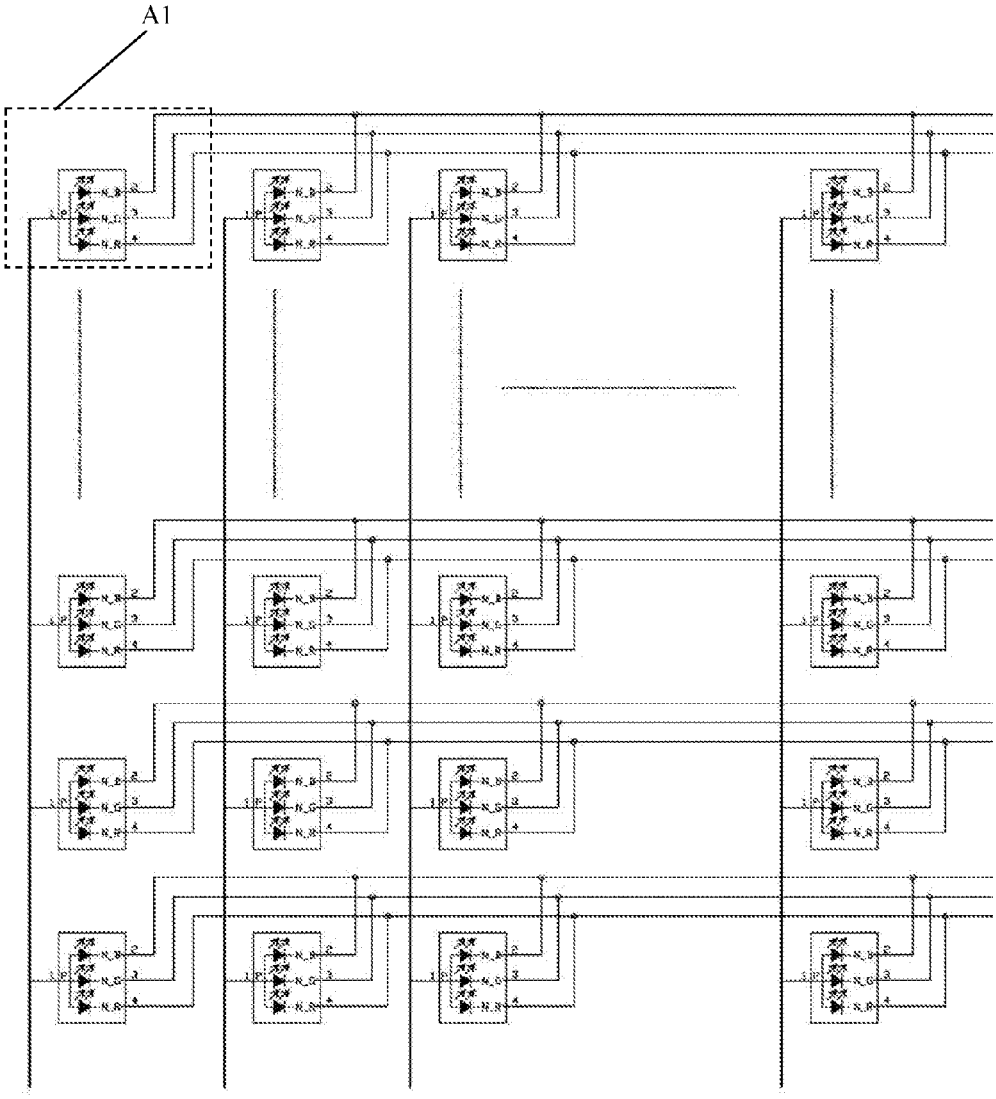
Fig.1b PRIOR ART
FIG. 1*b* is a drawing of partial enlargement of a dotted part A in FIG. 1*a;*
Figure 1C:
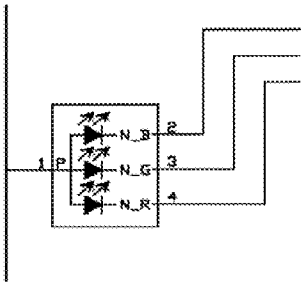
Fig.1c PRIOR ART
FIG. 1*c* is a drawing of partial enlargement of a dotted part A1 in FIG. 1*b;*
Figure 2A:
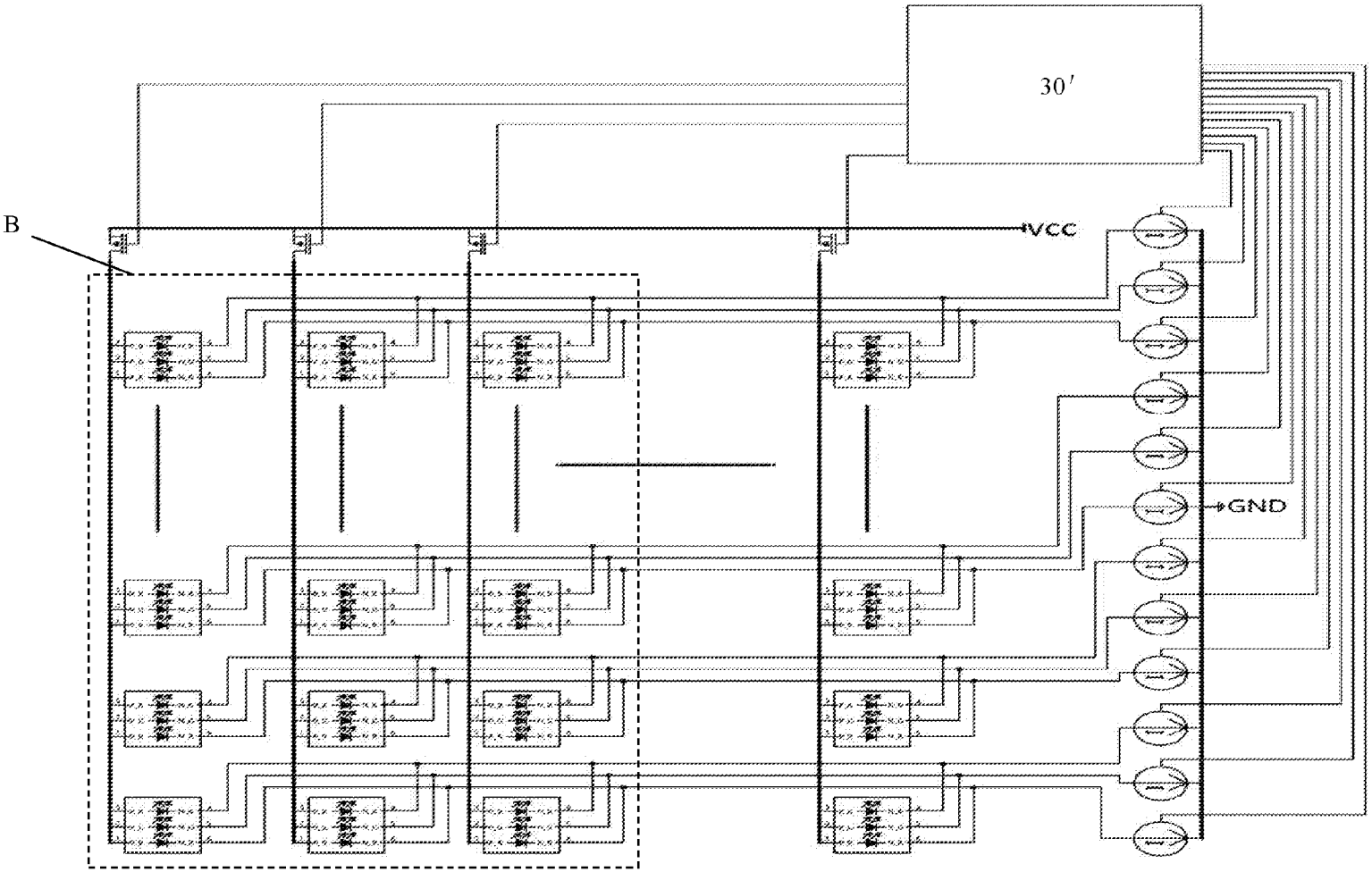
Fig.2a PRIOR ART
FIG. 2*a* is a split placement circuit diagram of an LED driving circuit for a 6-pin R/G/B three-in-one LED in related art.
Figure 2B:
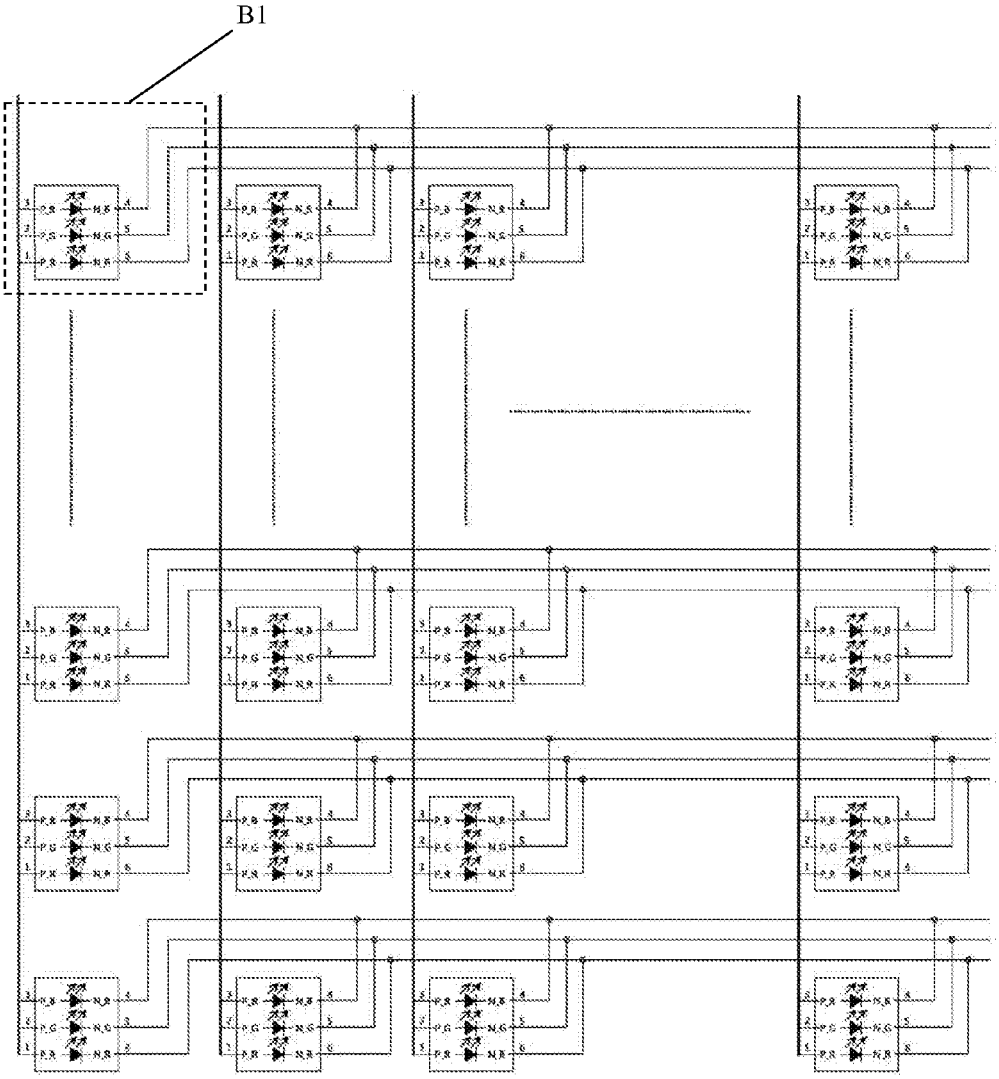
Fig.2b PRIOR ART
FIG. 2*b* is a drawing of partial enlargement of a dotted part B in FIG. 2*a;*
Figure 2C:
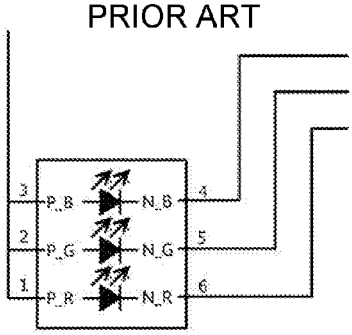
Fig.2c PRIOR ART
FIG. 2*c* is a drawing of partial enlargement of a dotted part B1 in FIG. 2*b;*
Figure 3A:
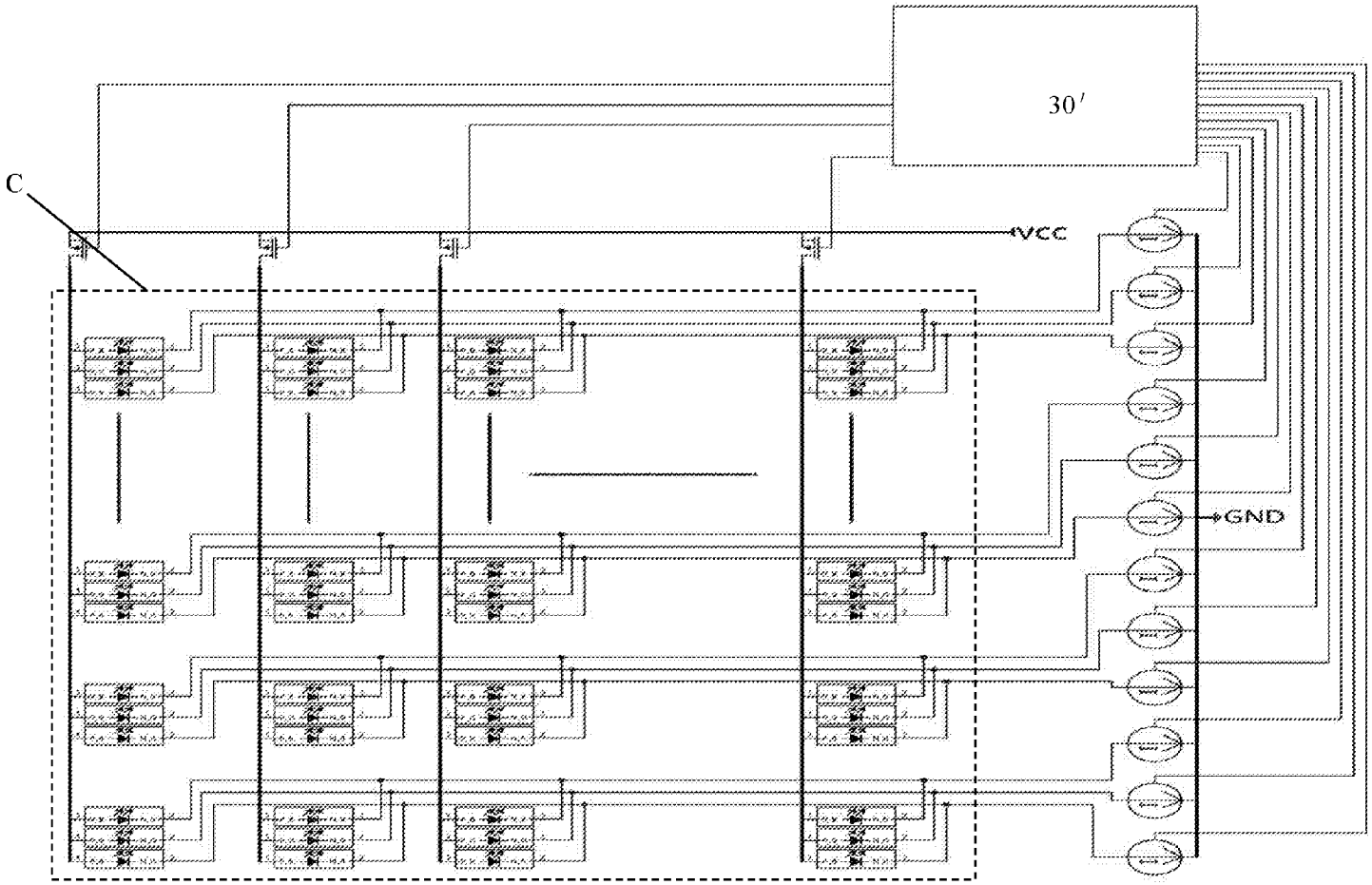
Fig.3a PRIOR ART
FIG. 3*a* is a split placement circuit diagram of an LED driving circuit for an R/G/B independent LED in related art.
Figure 3B:
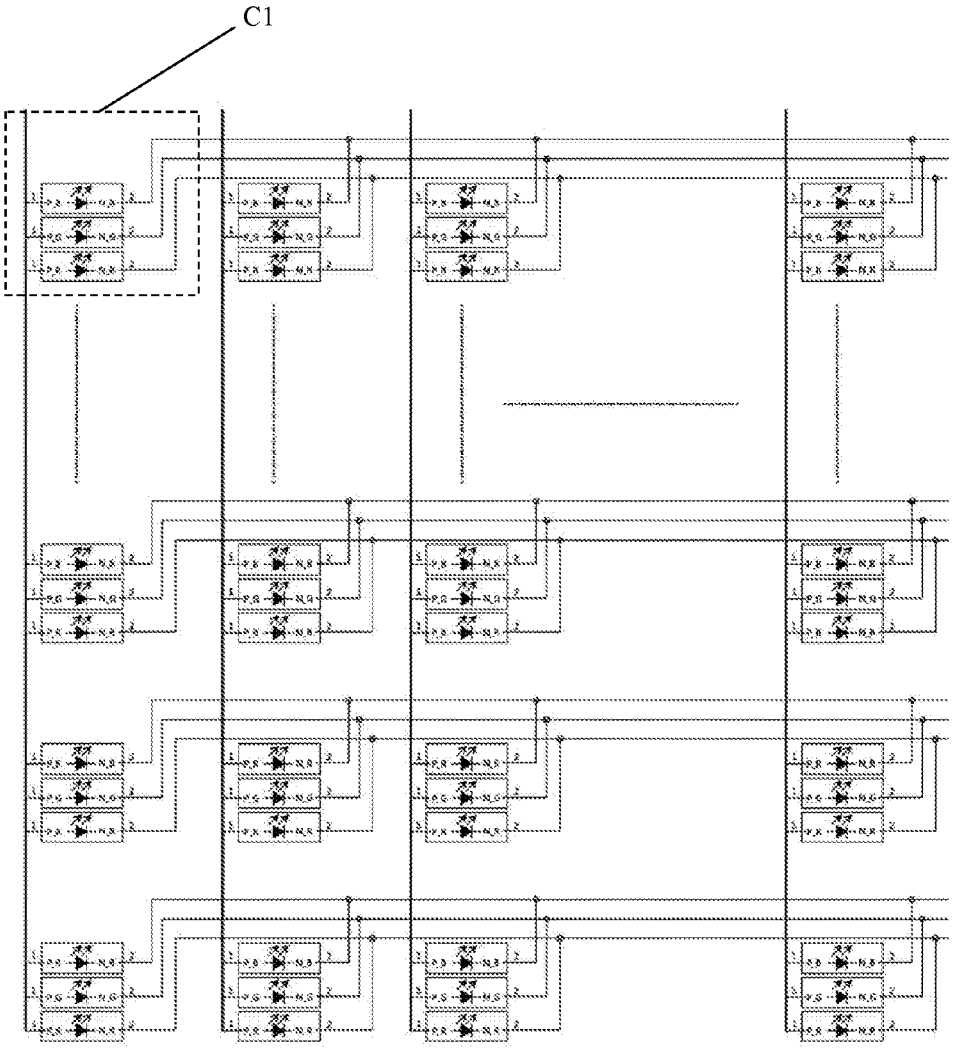
Fig.3b PRIOR ART
FIG. 3*b* is a drawing of partial enlargement of a dotted part C in FIG. 3*a;*
Figure 3C:
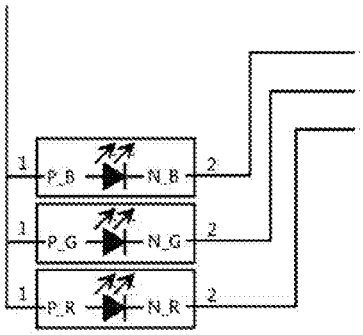
Fig.3c PRIOR ART
FIG. 3*c* is a drawing of partial enlargement of a dotted part C1 in FIG. 3*b;*
Figure 4:
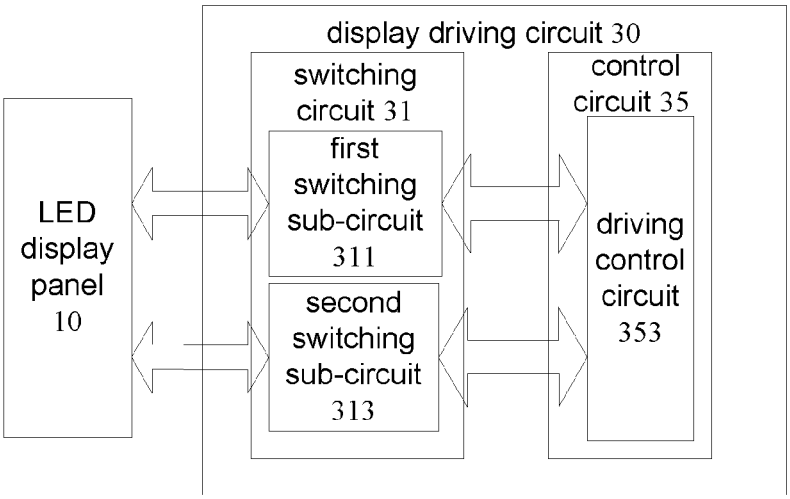
FIG. 4 is a structure diagram of an LED display according to embodiment 1 of the disclosure.

FIG. 4 is a structure diagram of an LED display according to embodiment 1 of the disclosure. As shown in FIG. 4, the LED display includes: an LED display panel 10; and a display driving circuit 30, the display driving circuit 30 includes a switching circuit 31 and a control circuit 35, wherein the switching circuit 31 includes a first switching sub-circuit 311 and a second switching sub-circuit 313; the first switching sub-circuit includes one or more field effect transistors, a source of each field effect transistor is connected with a power end of first power supply equipment, a drain of each field effect transistor is connected with an anode of an R lamp tube in each LED particle in a corresponding line in the LED display panel, and a gate of each field effect transistor is connected with a corresponding connection terminal in a power supply control port, and is configured to control the power supply of the corresponding R lamp tube of the LED display panel; the second switching sub-circuit includes one or more field effect transistors, a source of each field effect transistor is connected with a power end of second power supply equipment, a drain of each field effect transistor is connected with anodes of G/B lamp tubes in each LED particle in a corresponding line in the LED display panel, and a gate of each field effect transistor is connected with a corresponding connection terminal in the power supply control port, and is configured to control the power supply of the G/B lamp tubes of the LED display panel; the control circuit includes a power supply control circuit; the power supply control circuit is connected with a third end of the switching circuit through the power supply control port, and is configured to control the switching-on or switching-off of the switching circuit; and the switching circuit is configured to control the power supply of the LED display panel.

According to the LED display, the switching circuit 31 and the control circuit 35 are integrated in the display driving circuit 30, and then more display driving circuits 30 may be placed under the condition of not changing an area of the LED display panel 10, so that a number ratio of the LED particles and the display driving circuits 30 on the LED display with a fixed area is reduced, and the refresh rate is increased; moreover, the switching circuit 31 includes the first switching sub-circuit 311 and the second switching sub-circuit 313, the two switching sub-circuits control the power supply of the R/G/B LEDs in the lines of an LED particle array with M lines and N columns in the LED display panel respectively, and the first power supply equipment and the second power supply equipment provide different working voltages for the two switching sub-circuits to provide different working voltages for the R lamp tubes and the G/B lamp tubes of the LED particles in the LED display panel respectively, so that the power consumption of the LED display may be lowered. The problems of large PCB area occupied by the control circuit 35 and low refresh rate of the LED display in related art are solved, and the effects of small PCB area occupied by the control circuit 35, simple design, high refresh rate and low power consumption of the LED display are achieved.

Wherein, the first power supply equipment and the second power supply equipment are not shown in FIG. 4, a power supply voltage of the first power supply equipment for the first switching sub-circuit preferably is 1.6V, which is obtained by subtracting a typical working voltage (1.8-2V) of the R lamp tubes from typical working voltages (3.4-3.6V) of the G/B lamp tubes, and the power supply voltage of the first power supply equipment for the first switching sub-circuit is lower than a power supply voltage of the second power supply equipment for the second switching sub-circuit.

Preferably, the power supply control circuit is configured to control each field effect transistor in the first switching sub-circuit to be switched on to supply power to the R lamp tubes in the LED particles in the lines corresponding to the field effect transistors in the first switching sub-circuit in the LED display panel; and the power supply control circuit is further configured to control the field effect transistor corresponding to one field effect transistor in the first switching sub-circuit in the second switching sub-circuit to be switched on to supply power to the G/B lamp tubes in each LED particle in the line corresponding to the field effect transistor in the first switching sub-circuit in the LED display panel.

The LED display may include: the LED display panel 10; and the display driving circuit 30, the display driving circuit 30 includes the switching circuit 31, a driving circuit 33 and the control circuit 35, wherein a first end of one of the switching circuit 31 and the driving circuit 33 is connected to a power end of power supply equipment, and a first end of the other of the switching circuit 31 and the driving circuit 33 is connected to a grounding end of the power supply equipment; a second end of one of the switching circuit 31 and the driving circuit 33 is connected with an anode of the LED display panel 10, and a second end of the other of the switching circuit 31 and the driving circuit 33 is connected to a cathode of the LED display panel 10; the control circuit 35 includes: a power supply control circuit 351 and a driving control circuit 353; the power supply control circuit 351 is connected with the third end of the switching circuit 31 through the power supply control port, and is configured to control the switching-on or switching-off of the switching circuit 31; the driving control circuit 353 is connected with a third end of the driving circuit 33 through a driving control port, and is configured to control the switching-on or switching-off of the driving circuit 33. Wherein, the switching circuit 31 is configured to control the power supply of the LED display panel 10, and the driving circuit 33 is configured to control the ordered display of the LED display panel 10.

The switching circuit 31, the driving circuit 33 and the control circuit 35 are integrated in the display driving circuit 30, and then more display driving circuits 30 may be placed under the condition of not changing the area of the LED display panel 10, so that the number ratio of the LED particles and the display driving circuits 30 on the LED display with the fixed area is reduced, and the refresh rate is increased; and a connection relationship between the LED particle array with M lines and N columns in the LED display panel and the display driving circuits 30 is clearer, and fewer connection lines are required, so that the design difficulty of a PCB is lowered. The problems of large PCB area occupied by the control circuit 35 and low refresh rate of the LED display in related art are solved, and the effects of small PCB area occupied by the control circuit 35, simple design and high refresh rate of the LED display are achieved.

Figure 5:
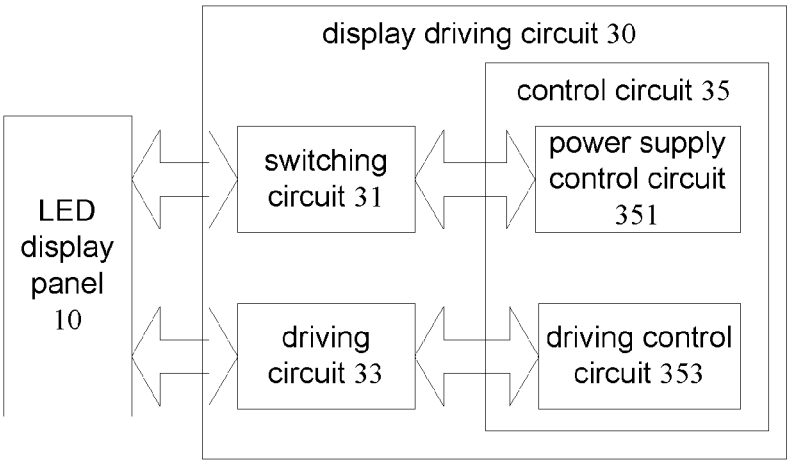
FIG. 5 is a structure diagram of an LED display according to a preferred embodiment of the disclosure.

As shown in FIG. 5, the display driving circuit in the display may also include: the driving circuit 33, wherein the first end of the driving circuit 33 is connected to the grounding end of the power supply equipment, and the second end of the driving circuit 33 is connected to the cathode of the LED display panel; the control circuit further includes: the driving control circuit, wherein the driving control circuit is connected with the third end of the driving circuit through the driving control port, and is configured to control the switching-on or switching-off of the driving circuit; and the driving circuit 33 is configured to control the ordered display of the LED display panel.

Figure 5A:
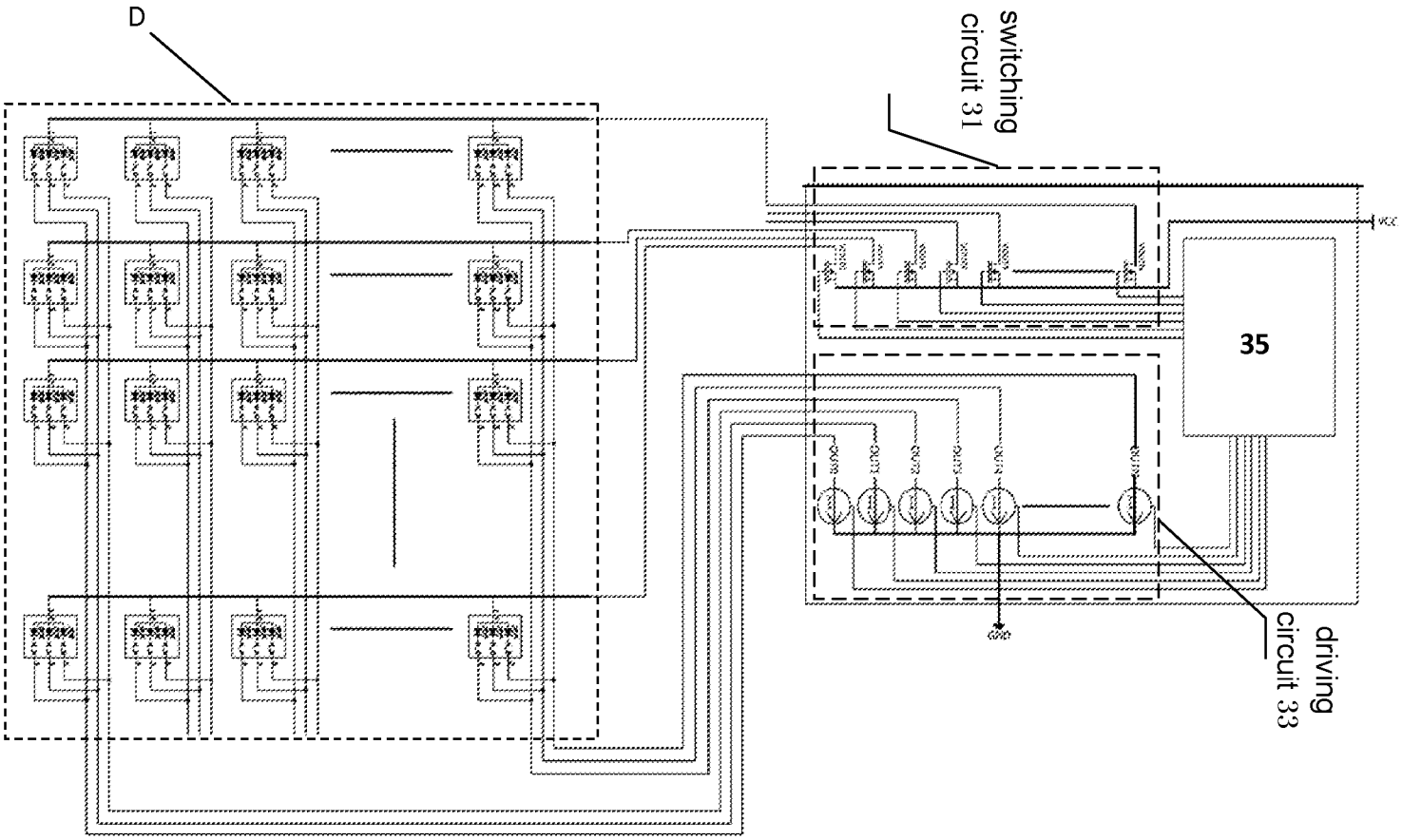
FIG. 5*a* is a detailed structure diagram of an LED display according to a preferred embodiment of the disclosure.
Figure 5B:
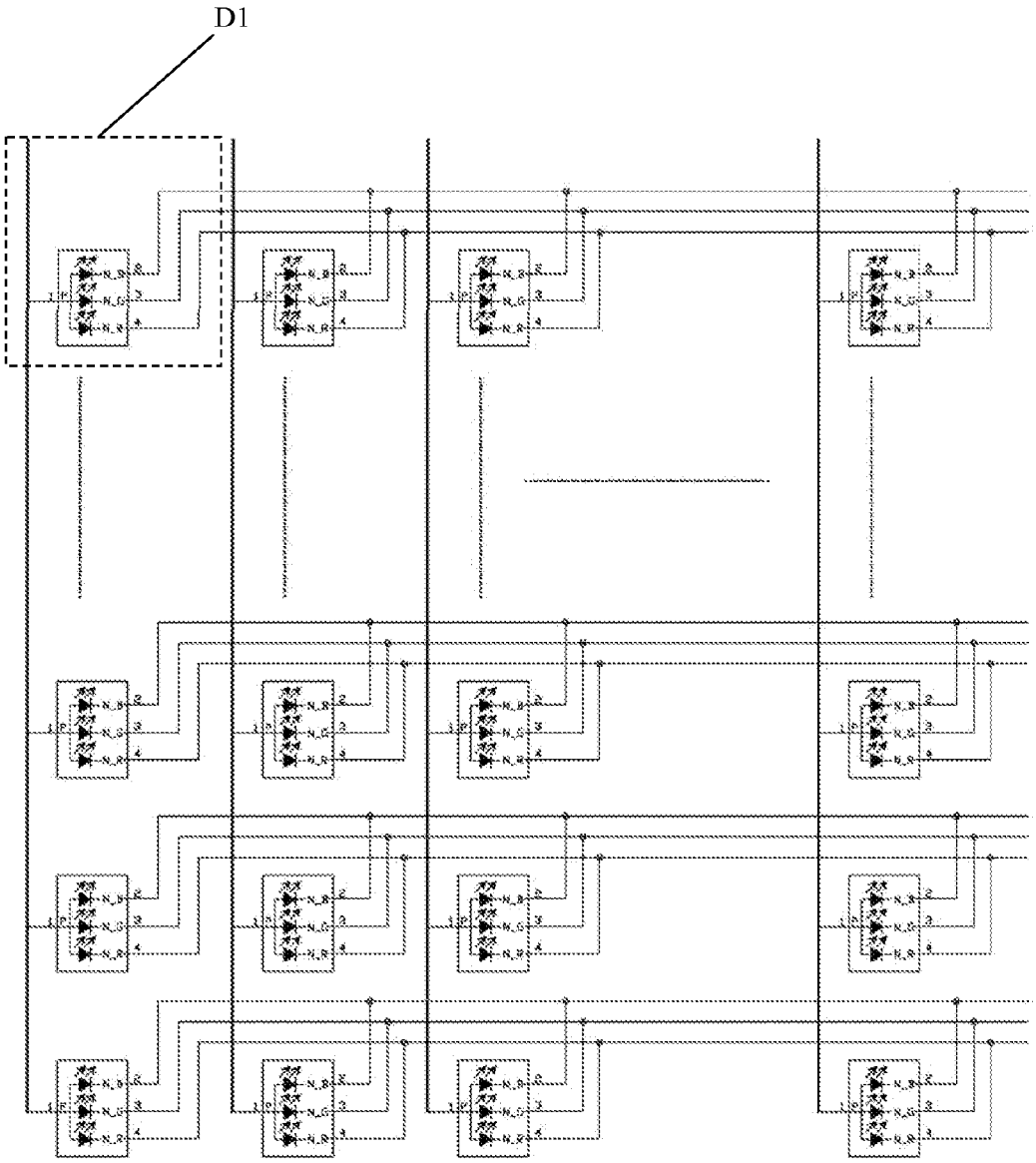
FIG. 5*b* is a drawing of partial enlargement of a dotted part D in FIG. 5*a;*
Figure 5C:
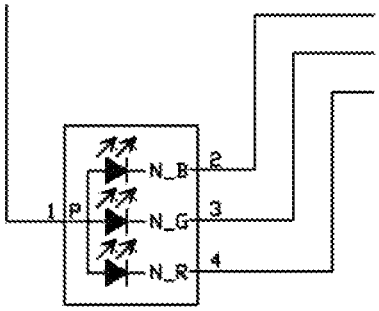
FIG. 5*c* is a drawing of partial enlargement of a dotted part D1 in FIG. 5*b;*

FIG. 5*a* to FIG. 5*c* are detailed structure diagrams of the LED display according to a preferred embodiment of the disclosure. As shown in FIG. 5, FIG. 5*a*, FIG. 5*b* and FIG. 5*c*, the switching circuit 31 may include one switching sub-circuit, and the switching sub-circuit includes one or more field effect transistors, wherein a source of each field effect transistor is connected with the power end or grounding end of the power supply equipment; a drain of each field effect transistor is connected with an anode or cathode of each LED particle in the corresponding line in the LED display panel 10; and a gate of each field effect transistor is connected with a corresponding connection terminal in the power supply control port respectively.

According to the embodiment of the disclosure, the driving circuit 33 may include a constant current channel group, and the constant current channel group includes one or more constant current logic components, wherein a first end of each constant current logic component is connected with the power end or grounding end of the power supply equipment; a second end of each constant current logic component is connected with the anodes or cathodes of the LED particles in a corresponding column in the LED display panel; and a third end of each constant current logic component is connected with the corresponding connection terminal in the driving control port respectively.

Specifically, the power supply control circuit 351 is configured to control each field effect transistor to be switched on to supply power to the LED particles in the line corresponding to the field effect transistor in the LED display panel 10; and the driving control circuit 353 is configured to control each constant current logic component in the constant current channel group to be switched on, and each constant current logic component provides a current path for the LED particles in the column corresponding to the constant current logic component in the LED display panel 10 respectively to control the ordered display of the LED particles after being switched on.

Specifically, the field effect transistors are P-MOS transistors, the LED display panel 10 includes M lines and N columns of LED particles, and each LED particle includes an R lamp tube, a G lamp tube and a B lamp tube, wherein an anode of the R lamp tube, an anode of the G lamp tube and an anode of the B lamp tube in an ith LED particle in each line are connected in parallel with an ith joint, and each joint in each line is connected in parallel, and is connected with the drain of one corresponding P-MOS transistor in the switching circuit 31; a cathode of the R lamp tube of each LED particle in each column is connected in parallel, and is connected with the second end of the corresponding constant current logic component in the constant current channel group; a cathode of the G lamp tube of each LED particle in each column is connected in parallel, and is connected with the second end of the corresponding constant current logic component in the constant current channel group; and a cathode of the B lamp tube of each LED particle in each column is connected in parallel, and is connected with the second end of the corresponding constant current logic component in the constant current channel group respectively. Wherein, i is more than or equal to 1 and less than or equal to N, and is a natural number, and the R lamp tubes, the G lamp tubes and the B lamp tubes may be R/G/B LEDs respectively.

Wherein, in the embodiment of the disclosure, FIG. 5*b* is a drawing of partial enlargement of a part D covered by a dotted line in FIG. 5*a*, the LED particle shown in FIG. 5*c* is a drawing of partial enlargement of a part D1 covered by a dotted line in FIG. 5*b*, and in FIG. 5*c*, pin 1 is a common anode, and pins 2/3/4 are cathodes of the R/G/B LEDs respectively.

The display driving circuit 30 includes a switching sub-circuit, the constant current channel group and the control circuit 35. The switching sub-circuit 31 includes N P-MOS transistors, wherein the drain of each P-MOS transistor serves as one of output pins of the control circuit 35, the source of each P-MOS transistor is connected to a power supply end (i.e. VCC end) of the display driving circuit 30, and the gate of each P-MOS transistor is connected with a connection terminal in the power supply control port of the control circuit 35; the constant current channel group may include N constant current logic components (which may also be called constant current logic circuits), the second end (input end of the constant current logic component in the embodiment) of each constant current logic component serves as one of input pins of the display driving circuit 30, the first ends (i.e. output ends) of all the constant current logic components are internally interconnected, and are connected with the grounding end of the power supply equipment as a grounding end (i.e. GND end) of the display driving circuit 30, and the third ends (control ends of the constant current logic components in the embodiment) of the constant current logic components are connected with the driving control port of the control circuit 35, and are configured to receive a constant current control signal of the driving circuit 33.

In embodiment 1, the LED display panel 10 (which may be called an LED unit as well as an LED unit board) includes a matrix with M lines and N columns of LED particles, wherein the anodes of the LED particles in each line are interconnected to the ith joint, each joint is connected to the output pin corresponding to the drain of one corresponding P-MOS transistor in the switching sub-circuit 31 in the display driving circuit 30, and the cathodes of the LEDs in the same basic colors in the LED particles in each column are interconnected to the input ends of the corresponding constant current logic components of the constant current channel group of the display driving circuit 30, that is, the common cathode of the R lamp tubes (i.e. R LEDs) in the LED particles in each column is interconnected to the input end of the corresponding constant current logic component of the constant current channel group of the display driving circuit 30; the common cathode of the G lamp tubes (i.e. G LEDs) in the LED particles in each column is interconnected to the input end of the corresponding constant current logic component of the constant current channel group of the display driving circuit 30; and the common cathode of the B lamp tubs (i.e. B LEDs) in the LED particles in each column is interconnected to the input end of the corresponding constant current logic component of the constant current channel group of the display driving circuit 30.

According to the LED display panel 10, under the control of the display driving circuit 30, the power supply control circuit 351 controls a certain P-MOS transistor in the switching circuit 31 (which may be the P-MOS channel group) to be in an on state through the power supply control port to supply power to the anodes of the LED particles in the corresponding line on the LED display panel 10, and the driving control circuit 353 outputs a constant current control signal to each constant current logic component in the constant current channel group through the driving control port to control each constant current logic component to be in an on working state, thereby providing the current paths for the cathodes of the lamp tubes of the LED particles in the corresponding columns and realizing the ordered display of the LED unit. Wherein, the cathodes of the lamp tubes of the LED particles in the corresponding columns include the cathodes of the R, G and B lamp tubes, that is, the ordered display of the R lamp tubes, the G lamp tubes and the B lamp tubes of the LED particles in the corresponding columns is controlled respectively.

In the embodiment of the disclosure, the field effect transistors may be P-MOS transistors, the LED display panel 10 includes M lines and N columns of LED particles, and each LED particle includes an R lamp tube, a G lamp tube and a B lamp tube, wherein the anode of the R lamp tube, the anode of the G lamp tube and the anode of the B lamp tube in each LED particle in each line are connected in parallel, and are connected with the drain of one corresponding P-MOS transistor in the switching circuit 31; the cathode of the R lamp tube of each LED particle in each column is connected in parallel, and is connected with the second end of the corresponding constant current logic component in the constant current channel group; the cathode of the G lamp tube of each LED particle in each column is connected in parallel, and is connected with the second end of the corresponding constant current logic component in the constant current channel group; and the cathode of the B lamp tube of each LED particle in each column is connected in parallel, and is connected with the second end of the corresponding constant current logic component in the constant current channel group respectively.

Based on the technical solution shown in embodiment 1, there may be a first transformed implementation mode as follows:

the anodes of the R/G/B LEDs of the LED particles in each line in the LED display panel 10 are interconnected to the output pin corresponding to the drain of one corresponding P-MOS transistor in the switching circuit 31 in the display driving circuit 30, and the cathodes of the LEDs in the same basic colors in the LED particles in each column are interconnected to the input ends of the corresponding constant current logic components of the constant current channel group of the display driving circuit 30, that is, the common cathode of the R LEDs in the LED particles in each column is interconnected to the input end of the corresponding constant current logic component of the constant current channel group of the display driving circuit 30; the common cathode of the G LEDs in the LED particles in each column is interconnected to the input end of the corresponding constant current logic component of the constant current channel group of the display driving circuit 30; and the common cathode of the B LEDs in the LED particles in each column is interconnected to the input end of the corresponding constant current logic component of the constant current channel group of the display driving circuit 30.

In the transformed mode, a connection relationship between the anodes of the LED particles in each line in the LED display panel 10 rather than a control mode of the display driving circuit 30 is changed, and in the transformed mode, the anodes of the R/G/B LEDs of the LED particles in each line are directly interconnected, and are connected to the output pin corresponding to the drain of one corresponding P-MOS transistor in the switching circuit. In the transformed mode, the switching circuit 31, the driving circuit 33 and the control circuit 35 are integrated in the display driving circuit 30, and then more display driving circuits 30 may be placed under the condition of not changing the area of the LED display panel 10, so that the number ratio of the LED particles and the display driving circuits 30 on the LED display with the fixed area is reduced, and the refresh rate is increased; moreover, the connection relationship between the LED particle array with M lines and N columns in the LED display panel and the display driving circuits 30 is clearer, and fewer connection lines are required, so that the design difficulty of the PCB is lowered.

Based on the technical solution shown in embodiment 1, there may also be a second transformed implementation mode as follows:

the field effect transistors may also be N-channel Metal Oxide Semiconductor (N-MOS) transistors, the LED display panel 10 may include M lines and N columns of LED particles, and each LED particle includes an R lamp tube, a G lamp tube and a B lamp tube, wherein the cathode of the R lamp tube, the cathode of the G lamp tube and the cathode of the B lamp tube in the ith LED particle in each line are connected in parallel with the ith joint, and each joint in each line is connected in parallel, and is connected to a drain of the corresponding N-MOS transistor in the switching circuit 31; the anode of the R lamp tube in each LED particle in each column is connected in parallel, and is connected with the second end of the corresponding constant current logic component in the constant current channel group; the anode of the G lamp tube of each LED particle in each column is connected in parallel, and is connected with the second end of the corresponding constant current logic component in the constant current channel group; and the anode of the B lamp tube of each LED particle in each column is connected in parallel, and is connected with the second end of the corresponding constant current logic component in the constant current channel group respectively. Wherein, i is more than or equal to 1 and less than or equal to N, and is a natural number.

Specifically, in the second transformed mode, the switching sub-circuit includes N N-MOS transistors, wherein the drain of each N-MOS transistor serves as one of output pins of the control circuit 35, the source of each N-MOS transistor is connected with the grounding end of the power supply equipment as the grounding end (i.e. GND end) of the display driving circuit 30, and the gate of each N-MOS transistor is connected with a connection terminal in the power supply control port of the control circuit 35; the constant current channel group includes N constant current logic components (which may also be called constant current logic circuits), the second end (i.e. input end) of each constant current logic component serves as one of the input pins of the display driving circuit 30, the first ends (i.e. output ends) of all the constant current logic components are internally interconnected, and are connected with the grounding end of the power supply equipment as the power supply end (i.e. VCC end) of the display driving circuit 30, and the third ends (i.e. control ends) of the constant current logic components are connected with the display control port of the control circuit 35, and are configured to receive the constant current control signal of the driving circuit 33.

In the second transformed mode, the LED display panel 10 (which may also be called an LED unit) includes a matrix with M lines and N columns of LED particles, wherein the cathodes of the LED particles in each line are interconnected to the ith joint, each joint is connected to the output pin corresponding to the drain of the corresponding N-MOS transistor in the switching circuit 31 in the display driving circuit 30, and the anodes of the LEDs in the same basic colors in the LED particles in each column are interconnected to the input ends of the corresponding constant current logic components of the constant current channel group of the display driving circuit 30, that is, the common anode of the R LEDs in the LED particles in each column is interconnected to the input end of the corresponding constant current logic component of the constant current channel group of the display driving circuit 30; the common anode of the G LEDs in the LED particles in each column is interconnected to the input end of the corresponding constant current logic component of the constant current channel group of the display driving circuit 30; and the common anode of the B LEDs in the LED particles in each column is interconnected to the input end of the corresponding constant current logic component of the constant current channel group of the display driving circuit 30.

In the transformed mode, the power supply control circuit 351 in the display driving circuit 30 controls any one N-MOS transistor in the switching circuit 31 to be in an on state through the power supply control port to supply power to the anodes of the LED particles in the corresponding line on the LED display panel 10, and the driving control circuit 353 outputs the constant current control signal to each constant current logic component in the constant current channel group through the driving control port to control each constant current logic component to be in an on working state, thereby providing the current path for the anodes of the lamp tubes of the LED particles in the corresponding columns and realizing the ordered display of the LED unit. Wherein, the anodes of the lamp tubes of the LED particles in the corresponding columns include the anodes of three basic colors R, G and B, that is, the ordered display of the R lamp tubes, the G lamp tubes and the B lamp tubes of the LED particles in the corresponding columns is also controlled respectively.

Based on the technical solution shown in the second transformed mode of embodiment 1, there may also be a transformed implementation mode as follows:

the field effect transistors may be N-MOS transistors, the LED display panel 10 may include M lines and N columns of LED particles, and each LED particle includes an R lamp tube, a G lamp tube and a B lamp tube, wherein the cathode of the R lamp tube, the cathode of the G lamp tube and the cathode of the B lamp tube in each LED particle in each line are connected in parallel, and are connected with the drain of the corresponding N-MOS transistor in the switching circuit 31; the anode of the R lamp tube of each LED particle in each column is connected in parallel, and is connected with the second end of the corresponding constant current logic component in the constant current channel group; the anode of the G lamp tube of each LED particle in each column is connected in parallel, and is connected with the second end of the corresponding constant current logic component in the constant current channel group; and the anode of the B lamp tube of each LED particle in each column is connected in parallel, and is connected with the second end of the corresponding constant current logic component in the constant current channel group respectively.

Specifically, the cathodes of the LED particles in each line in the LED display panel 10 in the implementation mode may be interconnected to the output pin corresponding to the drain of the corresponding N-MOS transistor in the switching circuit 31 in the display driving circuit 30, and the anodes of the LEDs in the same basic colors in the LED particles in each column are interconnected to the input ends of the corresponding constant current logic components of the constant current channel group of the display driving circuit 30, that is, the common anode of the R LEDs in the LED particles in each column is interconnected to the input end of the corresponding constant current logic component of the constant current channel group of the display driving circuit 30; the common anode of the G LEDs in the LED particles in each column is interconnected to the input end of the corresponding constant current logic component of the constant current channel group of the display driving circuit 30; and the common anode of the B LEDs in the LED particles in each column is interconnected to the input end of the corresponding constant current logic component of the constant current channel group of the display driving circuit 30.

Based on the technical solution shown in embodiment 1, there may also be a third transformed implementation mode as follows:

in the implementation mode, the driving circuit 33 may include a first constant current channel group, a second constant current channel group and a third constant current channel group, wherein the first constant current channel group includes one or more constant current logic components, a first end of each constant current logic component is connected with the power end or grounding end of the power supply equipment, a third end of each constant current logic component is connected with a first R display control sub-port of the driving control port, and a second end of each constant current logic component is connected with the anode or cathode of the R lamp tube in each LED particle in the corresponding column in the LED display panel 10, and is configured to control the display of the R lamp tubes of the LED display panel 10; the second constant current channel group includes one or more constant current logic components, a first end of each constant current logic component is connected with the power end or grounding end of the power supply equipment, a third end of each constant current logic component is connected with a first G display control sub-port of the driving control port, and a second end of each constant current logic component is connected with the anode or cathode of the G lamp tube in each LED particle in the corresponding column in the LED display panel 10, and is configured to control the display of the G lamp tubes of the LED display panel 10; and the third constant current channel group includes one or more constant current logic components, a first end of each constant current logic component is connected with the power end or grounding end of the power supply equipment, a third end of each constant current logic component is connected with a first B display control sub-port of the driving control port, and a second end of each constant current logic component is connected with the anode or cathode of the B lamp tube in each LED particle in the corresponding column in the LED display panel 10, and is configured to control the display of the B lamp tubes of the LED display panel 10 respectively. Wherein, the first constant current channel group may be an R constant current channel group, the second constant current channel group may be a G constant current channel group, and the third constant current channel group may be a B constant current channel group.

Specifically, the R constant current channel group may include one or more constant current logic components, the second ends (i.e. input ends) of these constant current logic components are connected to the cathodes (i.e. R cathodes) of the R lamp tubes of the LED particles in the corresponding columns in the LED display panel 10, the first ends (i.e. output ends) of the constant current logic components are interconnected as an external pin GND of the display driving circuit 30, and are connected to the grounding end of the power supply equipment, and the third ends (i.e. control ends) of the constant current logic components are connected to the first R display control sub-port of the driving control port to receive an R display control signal of the driving control circuit 353; the G constant current channel group may include one or more constant current logic components, the second ends (i.e. input ends) of these constant current logic components are connected to the cathodes (i.e. G cathodes) of the G lamp tubes of the LED particles in the corresponding columns in the LED display panel 10, the first ends (i.e. output ends) of the constant current logic components are interconnected as the external pin GND of the display driving circuit 30, and are connected to the grounding end of the power supply equipment, and the third ends (i.e. control ends) of the constant current logic components are connected to the first G display control sub-port of the driving control port to receive a G display control signal of the driving control circuit 353; and the B constant current channel group may include one or more constant current logic components, the second ends (i.e. input ends) of these constant current logic components are connected to the cathodes (i.e. B cathodes) of the B lamp tubes of the LED particles in the corresponding columns in the LED display panel 10, the first ends (i.e. output ends) of the constant current logic components are interconnected as the external pin GND of the display driving circuit 30, and are connected to the grounding end of the power supply equipment, and the third ends (i.e. control ends) of the constant current logic components are connected to the first B display control sub-port of the driving control port to receive a B display control signal of the driving control circuit 353.

In the implementation mode, the power supply control circuit 351 controls each field effect transistor to be switched on to supply power to the LED particles in the lines corresponding to the field effect transistors in the LED display panel 10; the driving control circuit 353 is configured to control each constant current logic component in the first constant current channel group to be switched on through the first R display control sub-port, and each constant current logic component provides a current path for the R lamp tubes in the LED particles in the column corresponding to the constant current logic component in the LED display panel 10 to control the display of the R lamp tubes of the LED particles in the line corresponding to the field effect transistor in the LED display panel 10 after being switched on; the driving control circuit 353 is further configured to control each constant current logic component in the second constant current channel group to be switched on through the first G display control sub-port, and each constant current logic component provides a current path for the G lamp tubes in the LED particles in the column corresponding to the constant current logic component in the LED display panel 10 to control the display of the G lamp tubes of the LED particles in the line corresponding to the field effect transistor in the LED display panel 10 after being switched on; and the driving control circuit 353 is further configured to control each constant current logic component in the third constant current channel group to be switched on through the first B display control sub-port, and each constant current logic component provides a current path for the B lamp tubes in the LED particles in the column corresponding to the constant current logic component in the LED display panel 10 to control the display of the B lamp tubes of the LED particles in the line corresponding to the field effect transistor in the LED display panel 10 after being switched on respectively.

In the implementation mode, the power supply control port of the display driving circuit 30 is unchanged, and the driving control port includes three control sub-ports for controlling the switching-on or switching-off of the first/second/third constant current channel groups to enable the switching circuit and the driving circuit to control the power supply of the LED particles in each line and the ordered display of the LED particles in each column in the LED display panel respectively. In the transformed mode, the switching circuit 31, the driving circuit 33 and the control circuit 35 are integrated in the display driving circuit 30, only the driving circuit includes the three constant current channel groups, and more display driving circuits 30 may still be placed under the condition of not changing the area of the LED display panel 10, so that the number ratio of the LED particles and the display driving circuits 30 on the LED display with the fixed area is reduced, and the refresh rate is increased; moreover, the connection relationship between the LED particle array in the LED display panel and the display driving circuits 30 is clearer, and fewer connection lines are required, so that the design difficulty of the PCB is lowered.

In the implementation mode, the field effect transistors may be P-MOS transistors, the LED display panel 10 includes M lines and N columns of LED particles, and each LED particle includes an R lamp tube, a G lamp tube and a B lamp tube, wherein the anode of the R lamp tube, the anode of the G lamp tube and the anode of the B lamp tube in the ith LED particle in each line are connected in parallel with the ith joint, and each joint in each line is connected in parallel, and is connected with the drain of one corresponding P-MOS transistor in the switching circuit 31; the cathode of the R lamp tube of each LED particle in each column is connected in parallel, and is connected with the second end of one corresponding constant current logic component in the first constant current channel group; the cathode of the G lamp tube of each LED particle in each column is connected in parallel, and is connected with the second end of the corresponding constant current logic component in the second constant current channel group; and the cathode of the B lamp tube of each LED particle in each column is connected in parallel, and is connected with the second end of the corresponding constant current logic component in the third constant current channel group respectively. Wherein, i is more than or equal to 1 and less than or equal to N, and is a natural number, and the R lamp tubes, the G lamp tubes and the B lamp tubes may be the R/G/B LEDs respectively.

In addition, the LED display panel 10 (which may also be called an LED unit) includes a matrix with M lines and N columns of LED particles, wherein the anodes of the LED particles in each line are interconnected to the ith joint, each joint is connected to the output pin corresponding to the drain of the corresponding N-MOS transistor in the switching circuit 31 in the display driving circuit 30, and the cathodes of the LEDs in the same basic colors in the LED particles in each column are interconnected to the input ends of the corresponding constant current logic components of the first constant current channel group of the display driving circuit 30, that is, the common cathode of the R LEDs in the LED particles in each column is interconnected to the input end of the corresponding constant current logic component of the second constant current channel group of the display driving circuit 30; the common cathode of the G LEDs in the LED particles in each column is interconnected to the input end of the corresponding constant current logic component of the constant current channel group of the display driving circuit 30; and the common cathode of the B LEDs in the LED particles in each column is interconnected to the input end of the corresponding constant current logic component of the third constant current channel group of the display driving circuit 30.

In the embodiment, the power supply control circuit 351 of the display driving circuit 30 controls any one P-MOS transistor in the switching circuit 31 to be in an on state through the power supply control port to supply power to the anodes of the LED particles in the corresponding line on the LED display panel 10, and the driving control circuit 353 outputs an R display control signal/G display control signal/B display control signal to each constant current logic component in the first constant current channel group/second constant current channel group/third constant current channel group through the first R display control sub-port/first G display control sub-port/first B display control sub-port to control each constant current logic component in the three constant current channel groups to be in an on working state, thereby providing the current paths for the R cathodes, G cathodes and B cathodes of the LED particles in the corresponding columns and realizing the ordered display of the LED particles. Wherein, the R cathodes, G cathodes and B cathodes of the LED particles in the corresponding columns are the cathodes of the R lamp tubes, the G lamp tubes and the G lamp tubes of the LED particles in the corresponding columns respectively. Wherein, the switching sub-circuit may also be called a P-MOS channel.

Based on the technical solution shown in the third transformed implementation mode of embodiment 1, there may also be a transformed implementation mode as follows:

the field effect transistors may be P-MOS transistors, the LED display panel 10 may include M lines and N columns of LED particles, and each LED particle includes an R lamp tube, a G lamp tube and a B lamp tube, wherein the anodes of the R lamp tube, the G lamp tube and the B lamp tube in each LED particle in each line are connected in parallel, and are connected with the drain of one corresponding P-MOS transistor in the switching circuit 31; the cathode of the R lamp tube of each LED particle in each column is connected in parallel, and is connected with the second end of the corresponding constant current logic component in the first constant current channel group; the cathode of the G lamp tube of each LED particle in each column is connected in parallel, and is connected with the second end of the corresponding constant current logic component in the second constant current channel group; and the cathode of the B lamp tube of each LED particle in each column is connected in parallel, and is connected with the second end of the corresponding constant current logic component in the third constant current channel group respectively.

Specifically, the anodes of the LED particles in each line in the LED display panel 10 are interconnected to the output pin corresponding to the drain of one corresponding P-MOS transistor in the switching circuit 31 in the display driving circuit 30, and the cathodes of the LEDs in the same basic colors in the LED particles in each column are interconnected to the input ends of the corresponding constant current logic components of the first constant current channel group of the display driving circuit 30, that is, the common cathode of the R LEDs in the LED particles in each column is interconnected to the input end of the corresponding constant current logic component of the second constant current channel group of the display driving circuit 30; the common cathode of the G LEDs in the LED particles in each column is interconnected to the input end of the corresponding constant current logic component of the constant current channel group of the display driving circuit 30; and the common cathode of the B LEDs in the LED particles in each column is interconnected to the input end of the corresponding constant current logic component of the third constant current channel group of the display driving circuit 30.

In the implementation mode, the control mode is the same as that of the display driving circuit 30 in the technical solution shown in the third transformed implementation mode of embodiment 1, and similarly, the power supply control circuit 351 controls a certain P-MOS transistor in the switching circuit 31 (i.e. the P-MOS channel group) to be in an on state through the power supply control port to supply power to the anodes of the LED particles in the corresponding line on the LED display panel 10, and the driving control circuit 353 outputs the R display control signal/G display control signal/B display control signal to each constant current logic component in the first constant current channel group/second constant current channel group/third constant current channel group through the first R display control sub-port/first G display control sub-port/first B display control sub-port to control each constant current logic component in the three constant current channel groups to be in an on working state, thereby providing the current paths for the R cathodes, G cathodes and B cathodes of the LED particles in the corresponding columns and realizing the ordered display of the LED particles. Wherein, the R cathodes, G cathodes and B cathodes of the LED particles in the corresponding columns are the cathodes of the R lamp tubes, the G lamp tubes and the B lamp tubes of the LED particles in the corresponding columns respectively.

Embodiment 2

Figure 6A:
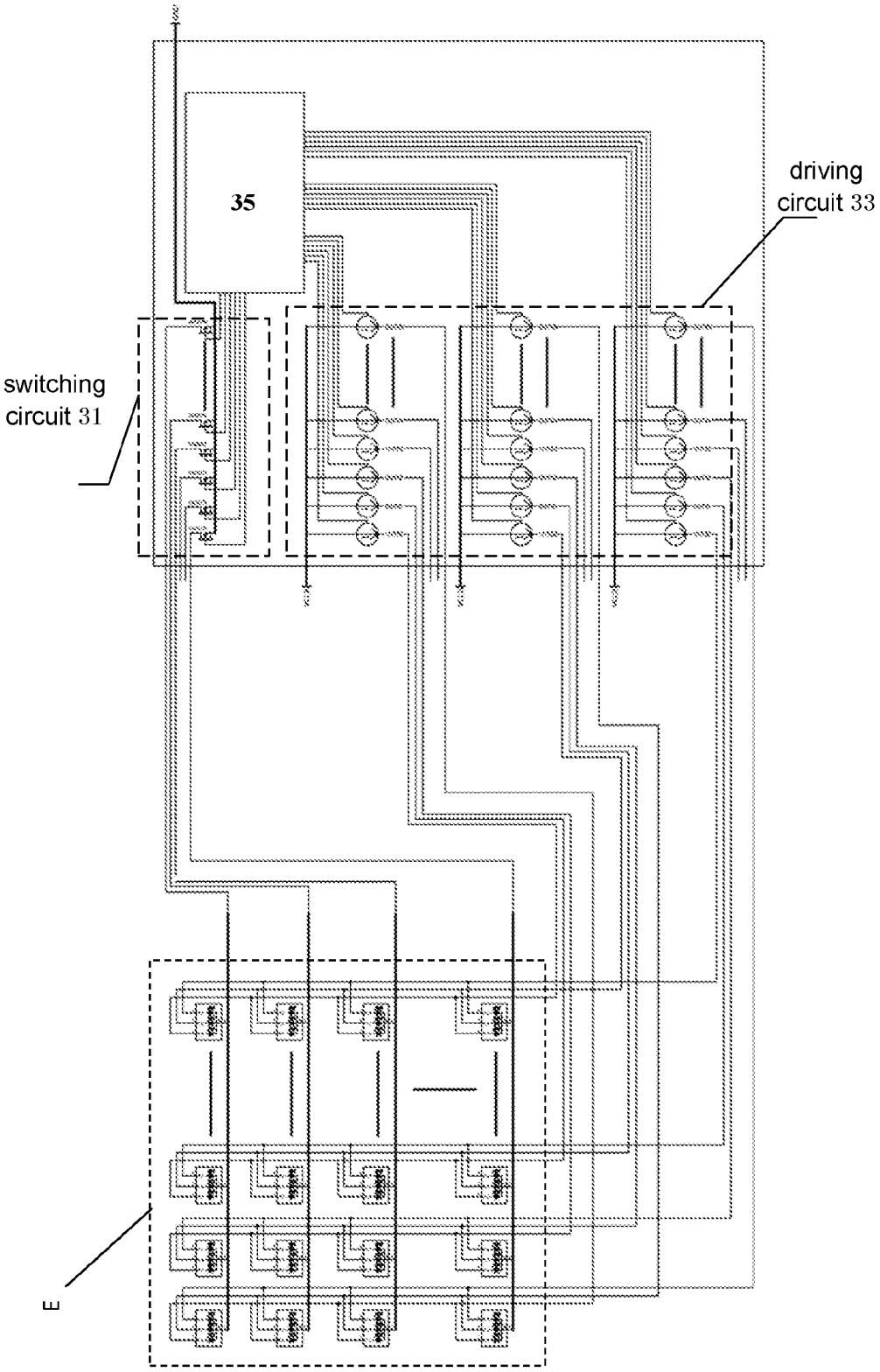
FIG. 6*a* is a structure diagram of an LED display according to embodiment 2 of the disclosure.
Figure 6B:
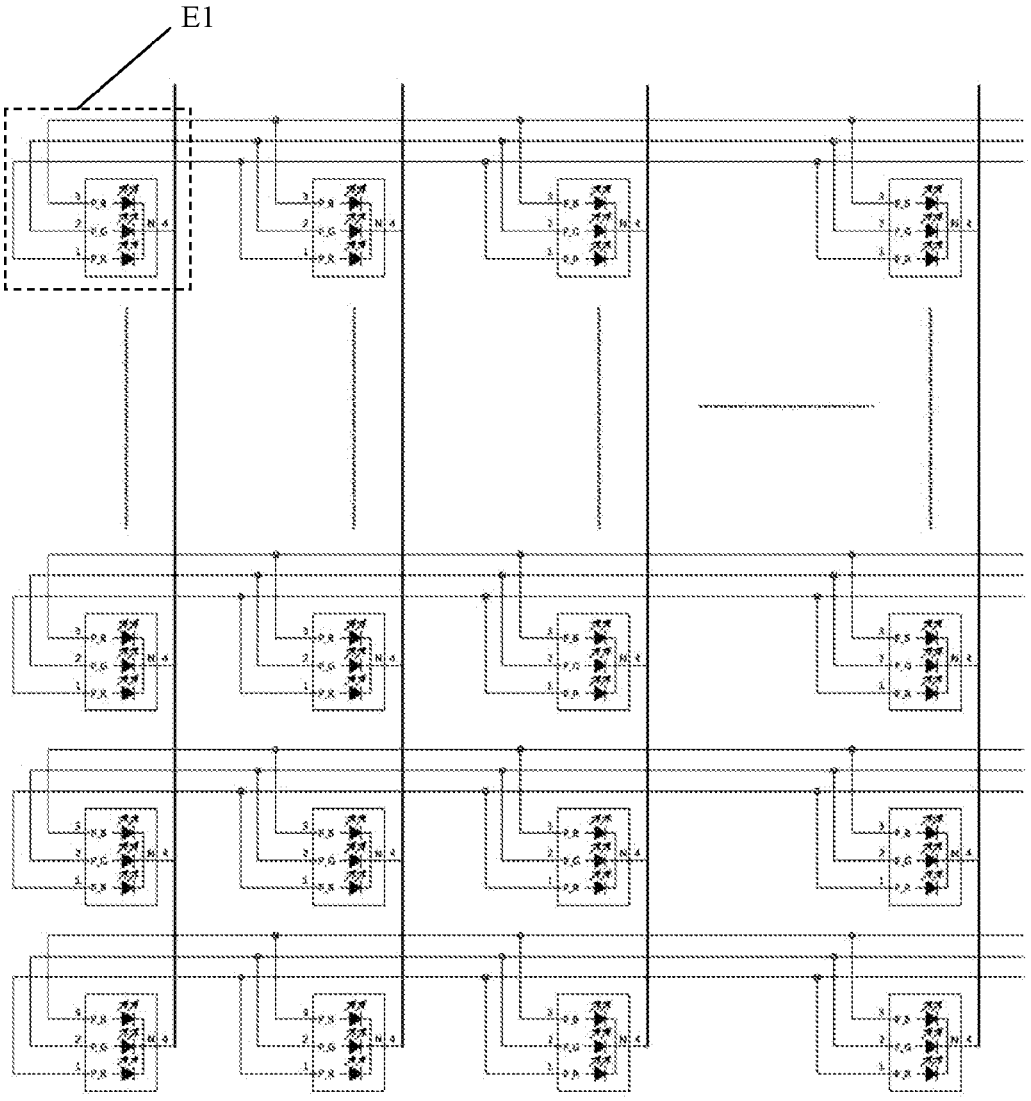
FIG. 6*b* is a drawing of partial enlargement of a dotted part E in FIG. 6*a;*
Figure 6C:
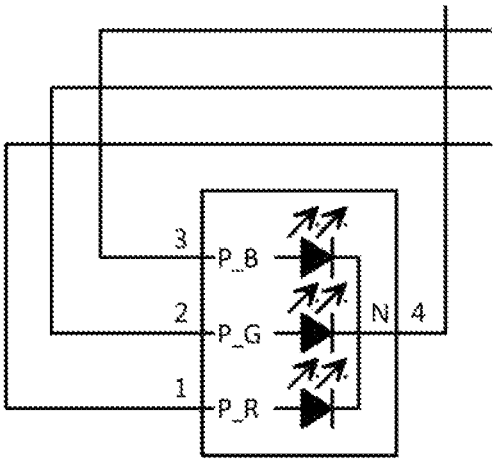
FIG. 6*c* is a drawing of partial enlargement of a dotted part E1 in FIG. 6*b;*

FIG. 6*a* to FIG. 6*c* are structure diagrams of an LED display according to embodiment 2 of the disclosure. As shown in FIG. 6*a*, field effect transistors in the LED display may also be N-MOS transistors, an LED display panel 10 may include M lines and N columns of LED particles, and each LED particle includes an R lamp tube, a G lamp tube and a B lamp tube, wherein a cathode of the R lamp tube, a cathode of the G lamp tube and a cathode of the B lamp tube in an ith LED particle in each line are connected in parallel with an ith joint, and each joint in each line is connected in parallel, and is connected with a drain of the corresponding N-MOS transistor in a switching circuit 31; an anode of the R lamp tube in each LED particle in each column is connected in parallel, and is connected with the second end of a corresponding constant current logic component in a first constant current channel group as a connection terminal of an anode of the LED display panel 10; an anode of the G lamp tube of each LED particle in each column is connected in parallel, and is connected with the second end of a corresponding constant current logic component in a second constant current channel group as a connection terminal of the anode of the LED display panel 10; and an anode of the B lamp tube of each LED particle in each column is connected in parallel, and is connected with the second end of a corresponding constant current logic component in a third constant current channel group as a connection terminal of the anode of the LED display panel 10 respectively.

Specifically, as shown in FIG. 6*a*, the R constant current channel group may include one or more constant current logic components, first ends (input ends in the embodiment) of these constant current logic components are interconnected as an external pin VCCR of the display driving circuit 30, and are connected to a grounding end of power supply equipment, second ends (i.e. output ends) of the constant current logic components are connected to the anodes (R anodes in the embodiment) of the R lamp tubes of the LED particles in the corresponding columns in the LED display panel 10, and third ends (i.e. control ends) of the constant current logic components are connected to a first R display control port; the G constant current channel group may include one or more constant current logic components, first ends (input ends in the embodiment) of these constant current logic components are interconnected as an external pin VCCG of the display driving circuit 30, and are connected to a power end of the power supply equipment, second ends (i.e. output ends) of the constant current logic components are connected to the anodes (G anodes) of the G lamp tubes of the LED particles in the corresponding columns in the LED display panel 10, and third ends (i.e. control ends) of the constant current logic components are connected to a first G display control port; and the B constant current channel group may include one or more constant current logic components, first ends (input ends in the embodiment) of the constant current logic components are interconnected as an external pin VCCB of the display driving circuit 30, and are connected to the power end of the power supply equipment, second ends (i.e. output ends) of the constant current logic components are connected to the anodes (B anodes in the embodiment) of the B lamp tubes of the LED particles in the corresponding columns in the LED display panel 10, and third ends (i.e. control ends) of the constant current logic components are connected to a first B display control port.

The LED particle shown in FIG. 6*c* is a drawing of partial enlargement of a part E1 covered by a dotted line in FIG. 6*b*, wherein pin 4 is a common cathode, and pins 1/2/3 are the anodes of R/G/B LEDs.

Wherein, in the embodiment, a power supply voltage of the external pin VCCR of the display driving circuit 30 may be lower than that of the external pin VCCR/VCCB, and specifically, the power supply voltage of the VCCR may be 1.6V which is obtained by subtracting a working voltage (1.8-2V) of the R lamp tubes from a working voltages (3.4-3.6V) of the G and B lamp tubes, and the power supply voltages of the R/G/B LEDs are differentially controlled, thereby reducing the power consumption of the LED display.

In embodiment 2, the LED display panel 10 (which may also be called an LED unit) includes a matrix with M lines and N columns of LED particles, wherein the cathodes of the LED particles in each line are interconnected to the ith joint, each joint is connected to an output pin corresponding to the drain of the corresponding N-MOS transistor in the switching circuit 31 in the display driving circuit 30, and the anodes of the LEDs in the same basic colors in the LED particles in each column are interconnected to the input ends of the corresponding constant current logic components of the constant current channel group of the display driving circuit 30, that is, the common anode of the R LEDs in the LED particles in each column is interconnected to the input end of the corresponding constant current logic component of the second constant current channel group of the display driving circuit 30; the common anode of the G LEDs in the LED particles in each column is interconnected to the input end of the corresponding constant current logic component of the constant current channel group of the display driving circuit 30; and the common anode of the B LEDs in the LED particles in each column is interconnected to the input end of the corresponding constant current logic component of the third constant current channel group of the display driving circuit 30. Under the control of the display driving circuit 30, the power supply control circuit 351 controls a certain N-MOS transistor in the switching circuit 31 (which may be an N-MOS channel group) to be in an on state through a power supply control port to supply power to the anodes of the LED particles in the corresponding line on the LED display panel 10, and the driving control circuit 353 outputs an R display control signal/G display control signal/B display control signal to each constant current logic component in the first constant current channel group/second constant current channel group/third constant current channel group through the first R display control sub-port/first G display control sub-port/first B display control sub-port to control each constant current logic component in the three constant current channel groups to be in an on working state, thereby providing the current paths for the R anodes, G anodes and B anodes of the LED particles in the corresponding columns and realizing the ordered display of the LED particles. Wherein, the R anodes, G anodes and B anodes of the LED particles in the corresponding columns are the anodes of the R lamp tubes, the G lamp tubes and the B lamp tubes of the LED particles in the corresponding columns respectively.

Embodiments 3 and 4

Figure 7A:
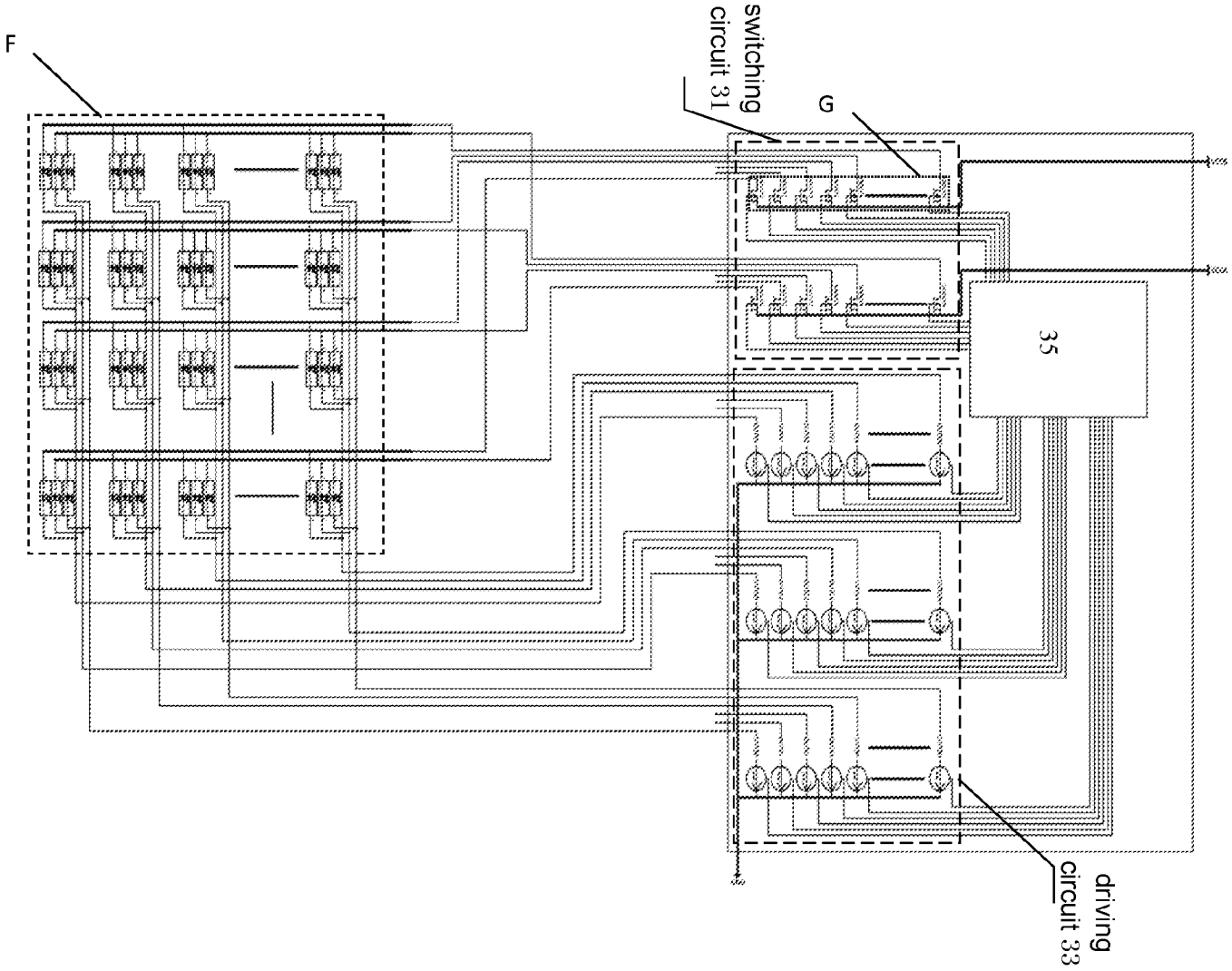
FIG. 7*a* is a structure diagram of an LED display according to embodiment 3 of the disclosure.
Figure 7B:
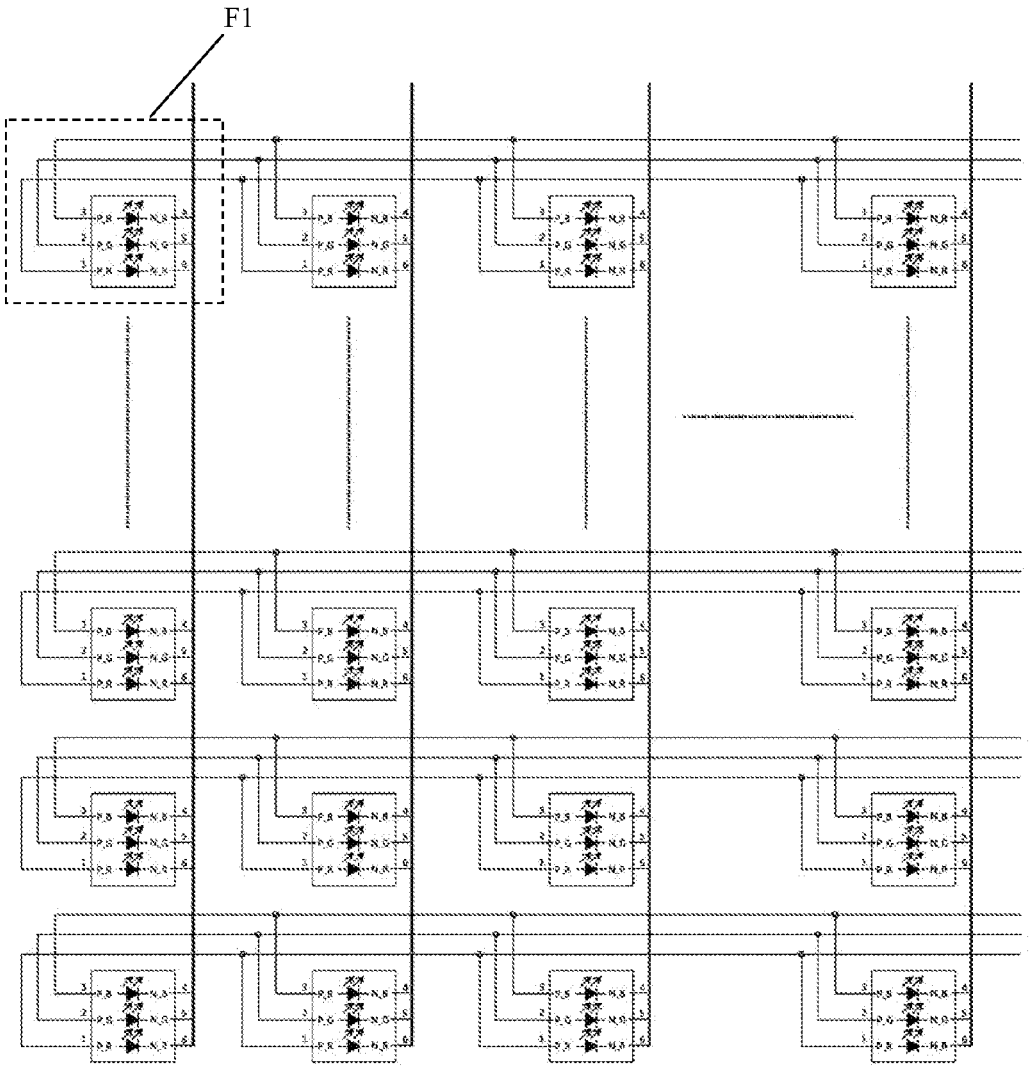
FIG. 7*b* is a drawing of partial enlargement of a dotted part F in FIG. 7*a;*
Figure 7C:
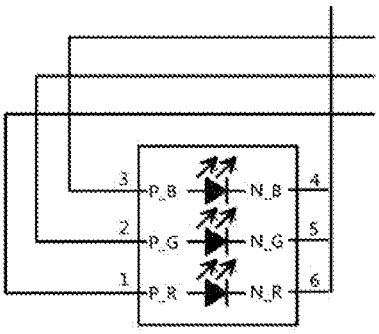
FIG. 7*c* is a drawing of partial enlargement of a dotted part F1 in FIG. 7*b;*
Figure 7D:
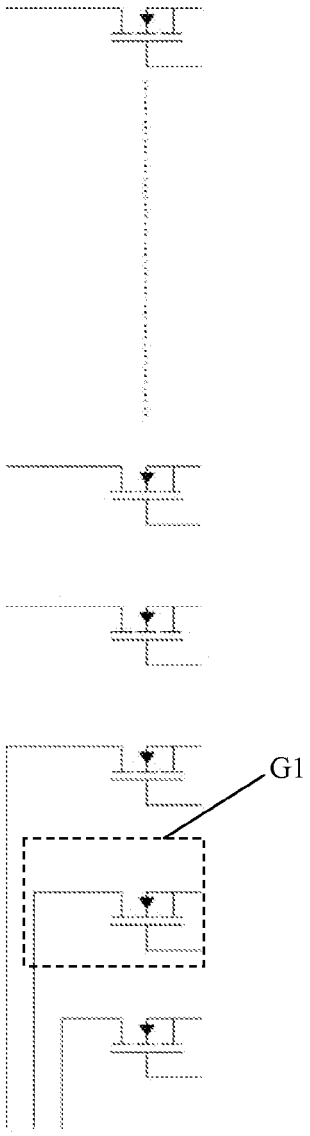
FIG. 7*d* is a drawing of partial enlargement of a switching circuit on a dotted part G in FIG. 7*a;*
Figure 7E:
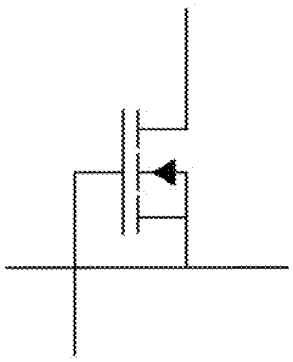
FIG. 7*e* is a drawing of partial enlargement of a dotted part G1 in FIG. 7*d;*
Figure 8A:
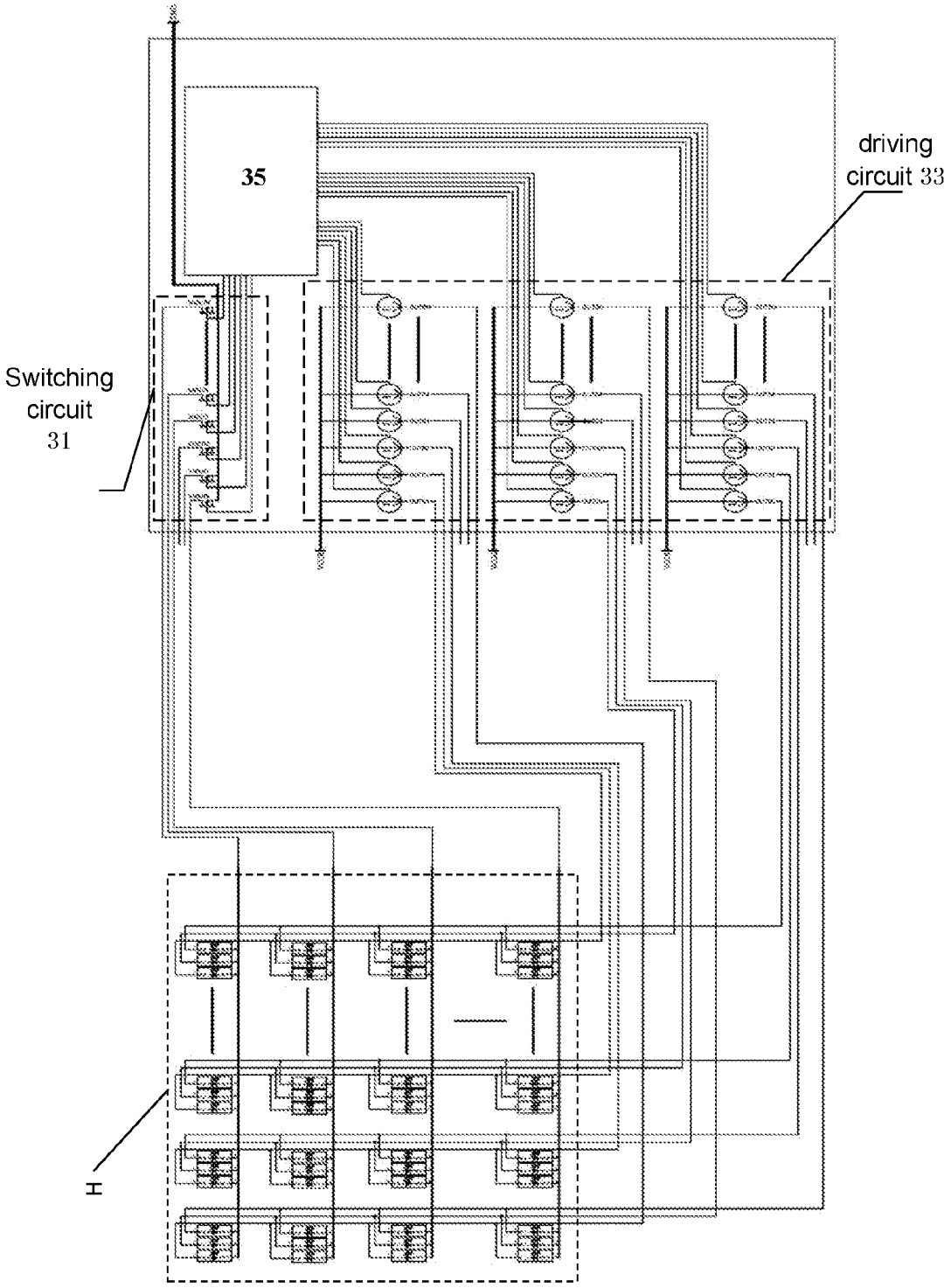
FIG. 8*a* is a structure diagram of an LED display according to embodiment 4 of the disclosure.
Figure 8B:
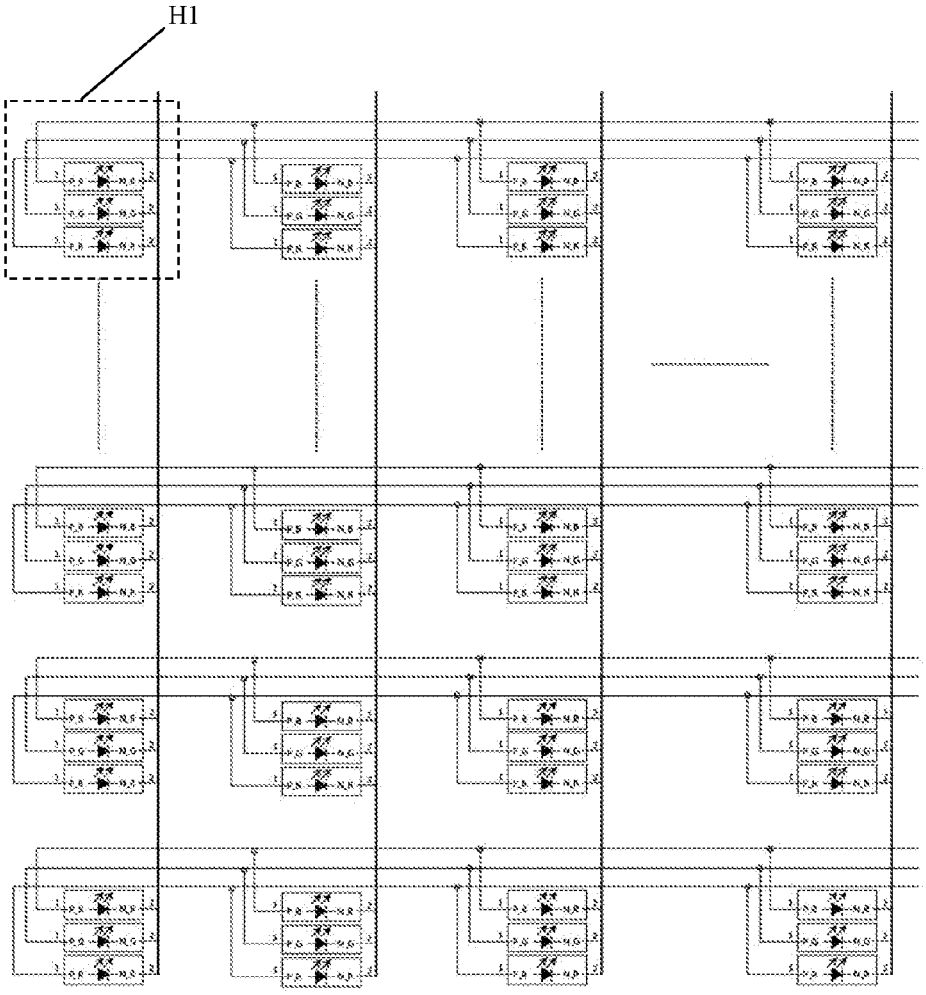
FIG. 8*b* is a drawing of partial enlargement of a dotted part H in FIG. 8*a;*
Figure 8C:
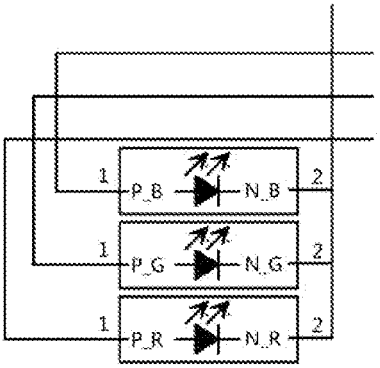
FIG. 8*c* is a drawing of partial enlargement of a dotted part H1 in FIG. 8*b;*

FIG. 7*a* to FIG. 7*e* are structure diagrams of an LED display according to embodiment 3 of the disclosure; and FIG. 8*a* to FIG. 8*c* are structure diagrams of an LED display according to embodiment 4 of the disclosure. FIG. 7*b* and FIG. 8*b* show drawings of partial enlargement of a part F covered by a dotted line in FIG. 7*a* and a part H covered by a dotted line in FIG. 8*a* in the two embodiments respectively, LEDs of three basic colors in an LED particle in FIG. 7*c* are directly integrated on the LED particle, LEDs in three basic colors in an LED particle in FIG. 8*c* are encapsulated and integrated on the LED particle respectively, but beyond that, the same circuit connection relationship may be adopted in the two implementation modes. Wherein, an anode of each LED particle in FIG. 7*c* has three pins, i.e. 1, 2 and 3 respectively, corresponding to anodes of internal R/G/B LEDs respectively, and a cathode of each LED particle in FIG. 7*c* has three pins, i.e. 4, 5 and 6 respectively, corresponding to cathodes of the internal R/G/B LEDs respectively; and as shown in FIG. 8*c*, the anodes of the R/G/B LEDs are pins 1, the cathodes of the R/G/B LEDs are pins 2, and the R/G/B LEDs are welded in parallel as the LED particles (i.e. full-color pixels).

Specifically, as shown in FIG. 7*e* and FIG. 8*a*, field effect transistors may also be N-MOS transistors, an LED display panel 10 may include M lines and N columns of LED particles, and each LED particle includes an R lamp tube, a G lamp tube and a B lamp tube, wherein the cathode of the R lamp tube, the cathode of the G lamp tube and the cathode of the B lamp tube in each LED particle in each line are connected in parallel, and are connected with the drain of the corresponding N-MOS transistor in a switching circuit 31; the anode of the R lamp tube in each LED particle in each column is connected in parallel, and is connected with the second end of a corresponding constant current logic component in a first constant current channel group; the anode of the G lamp tube of each LED particle in each column is connected in parallel, and is connected with the second end of a corresponding constant current logic component in a second constant current channel group; and the anode of the B lamp tube of each LED particle in each column is connected in parallel, and is connected with the second end of a corresponding constant current logic component in a third constant current channel group respectively.

In embodiments 3 and 4, the anodes of the LED particles in each line in the LED display panel 10 are interconnected to an output pin corresponding to the drain of the corresponding N-MOS transistor in the switching circuit 31 in the display driving circuit 30, the cathodes of the LED particles in each line are interconnected to an ith joint, each joint is connected to the output pin corresponding to the drain of the corresponding N-MOS transistor in the switching circuit 31 in the display driving circuit 30, and the anodes of the LEDs in the same basic colors in the LED particles in each column are interconnected to the input ends of the corresponding constant current logic components of the first constant current channel group of the display driving circuit 30, that is, the common anode of the R LEDs in the LED particles in each column is interconnected to the input end of the corresponding constant current logic component of the second constant current channel group of the display driving circuit 30; the common anode of the G LEDs in the LED particles in each column is interconnected to the input end of the corresponding constant current logic component of the constant current channel group of the display driving circuit 30; and the common cathode of the B LEDs in the LED particles in each column is interconnected to the input end of the corresponding constant current logic component of the third constant current channel group of the display driving circuit 30.

Based on the technical solutions shown in embodiments 3 and 4, there may also be a first transformed implementation mode as follows:

in the implementation mode, the switching circuit 31 includes a first switching sub-circuit and a second switching sub-circuit, each of the first switching sub-circuit and the second switching sub-circuit includes one or more field effect transistors, and a source of each field effect transistor in the first switching sub-circuit and the second switching sub-circuit is connected with a power end or grounding end of power supply equipment, wherein a drain of each field effect transistor in the first switching sub-circuit is connected with the anode or cathode of the R lamp tube in each LED particle in the corresponding line in the LED display panel, and a gate of each field effect transistor is connected with a corresponding connection terminal in a power supply control port, and is configured to control the power supply of the R lamp tubes of the LED display panel; and a drain of each field effect transistor in the second switching sub-circuit is connected with the anodes or cathodes of the G lamp tube and the B lamp tube in each LED particle in the corresponding line in the LED display panel, and a gate of each field effect transistor is connected with a corresponding connection terminal in the power supply control port, and is configured to control the power supply of the G lamp tubes and the B lamp tubes of the LED display panel.

In the implementation mode, the driving circuit 33 may include a constant current channel group, and the constant current channel group may include: one or more constant current logic components, wherein a first end of each constant current logic component is connected with the power end or grounding end of the power supply equipment; a second end of each constant current logic component is connected with the anodes or cathodes of the LED particles in the corresponding column in the LED display panel 10; and a third end of each constant current logic component is connected with the corresponding connection terminal in the driving control port respectively.

In addition, in the embodiment, the power supply control circuit 351 is configured to control one field effect transistor in the first switching sub-circuit to be switched on to supply power to the R lamp tubes in the LED particles in the line corresponding to the field effect transistor in the first switching sub-circuit in the LED display panel 10; the power supply control circuit 351 is further configured to control the field effect transistor corresponding to the switched-on field effect transistor in the first switching sub-circuit in the second switching sub-circuit to be switched on to supply power to the G lamp tubes and the B lamp tubes in the LED particles in the line corresponding to the field effect transistor in the first switching sub-circuit in the LED display panel 10; and the driving control circuit 353 is configured to control each constant current logic component in the constant current channel group to be switched on, and each constant current logic component provides a current path for the LED particles in the column corresponding to the constant current logic component in the LED display panel 10 respectively to control the ordered display of the LED particles in the line corresponding to the field effect transistor in the LED display panel 10 after being switched on.

The switching circuit 31, the driving circuit 33 and the control circuit 35 are integrated in the display driving circuit 30, and then more display driving circuits 30 may be placed under the condition of not changing the area of the LED display panel 10, so that the number ratio of the LED particles and the display driving circuits 30 on the LED display with the fixed area is reduced, and the refresh rate is increased.

The field effect transistors of the display driving circuit 30 in the embodiment may be P-MOS transistors, the LED display panel 10 may include M lines and N columns of LED particles, and each LED particle includes an R lamp tube, a G lamp tube and a B lamp tube, wherein the anode of the R lamp tube in the ith LED particle in each line is connected in parallel with the ith joint, and each joint in each line is connected in parallel, and is connected with the drain of one corresponding P-MOS transistor in the first switching sub-circuit 31; the anodes of the G lamp tube and the B lamp tube in the jth LED particle in each line are connected in parallel with a jth joint, and each joint in each line is connected in parallel, and is connected to the drain of one corresponding P-MOS transistor in the second switching sub-circuit 31; the cathode of the R lamp tube of each LED particle in each column is connected in parallel, and is connected with the second end of the corresponding constant current logic component in the constant current channel group; the cathode of the G lamp tube of each LED particle in each column is connected in parallel, and is connected with the second end of the corresponding constant current logic component in the constant current channel group; and the cathode of the B lamp tube of each LED particle in each column is connected in parallel, and is connected with the second end of the corresponding constant current logic component in the constant current channel group respectively. Wherein, i is more than or equal to 1 and less than or equal to N, j is more than or equal to 1 and less than or equal to N, both i and j are natural numbers, and the R lamp tubes, the G lamp tubes and the B lamp tubes may be R/G/B LEDs.

In the implementation mode, the display driving circuit 30 integrates the first switching sub-circuit and the second switching sub-circuit, and each of the two switching sub-circuits includes one or more P-MOS transistors; the source of each P-MOS transistor of the first switching sub-circuit is interconnected as an external pin VCCB of the display driving circuit 30, and is connected to a connection terminal of the power end of the power supply equipment, the gate of each P-MOS transistor is connected to an R power supply control signal of the power supply control port, and the drain of each P-MOS transistor is connected to the anodes (i.e. R anodes of the LED particles in the corresponding line) of the R lamp tubes of the LED particles in the corresponding line in the LED display panel 10; and the source of each P-MOS transistor of the second switching sub-circuit is interconnected as an external pin VCCA of the display driving circuit 30, and is connected to a connection terminal of the power end of the power supply equipment, the gate of each P-MOS transistor is connected to G and B power supply control signals of the power supply control port, and the drain of each P-MOS transistor is connected to the anodes (i.e. G anodes and B anodes of the LED particles in the corresponding line) of the G lamp tubes and the B lamp tubes of the LED particles in the corresponding line in the LED display panel 10.

The driving circuit 33 may be the same as that shown in embodiment 1, and may include a constant current channel group, wherein the constant current channel group includes multiple constant current logic components (which may also be called constant current logic circuits); and a second end (i.e. input end) of each constant current logic component serves as one of input pins of the display driving circuit 30, first ends (i.e. output ends) of all the constant current logic components are internally interconnected, and are connected to the grounding end (i.e. GND end) of the display driving circuit 30, and third ends (i.e. control ends) of the constant current logic components are connected with the driving control port of the control circuit 35, and are configured to receive a constant current control signal of the driving circuit 33.

In the implementation mode, the anode of the R lamp tube in the ith LED particle in each line in the LED display panel is connected in parallel with the ith joint, and each joint in each line is connected in parallel, and is connected with the drain of one corresponding P-MOS transistor in the first switching sub-circuit 31; the anodes of the G lamp tube and the B lamp tube in the jth LED particle in each line are connected in parallel with the jth joint, and each joint in each line is connected in parallel, and is connected to the drain of one corresponding P-MOS transistor in the second switching sub-circuit 31 respectively; the cathodes of the LEDs in the same basic colors in each LED particle in each column are interconnected to the input ends of the corresponding constant current logic components in the constant current channel group of the display driving circuit 30, that is, the common cathode of the R lamp tubes (i.e. R display units) in the LED particles in each column is interconnected to the input end of the corresponding constant current logic component of the constant current channel group of the display driving circuit 30; the common cathode of the G lamp tubes (i.e. G display units) in the LED particles in each column is interconnected to the input end of the corresponding constant current logic component of the constant current channel group of the display driving circuit 30; and the common cathode of the B lamp tubes (i.e. B display units) in the LED particles in each column is interconnected to the input end of the corresponding constant current logic component of the constant current channel group of the display driving circuit 30.

In the implementation mode, power supply voltages of the first switching sub-circuit and the second switching sub-circuit may be different, a power supply voltage of VCCB is preferably 1.6V, and may be lower than that of the pin VCCA, and 1.6V is obtained by subtracting a typical working voltage (1.8-2V) of the R lamp tubes from typical working voltages (3.4-3.6V) of the G and B lamp tubes, so that the power supply voltages of the R/G/B LEDs are differentially controlled to further reduce the power consumption of the LED display.

In the implementation mode, the power supply control circuit 351 of the display driving circuit 30 controls the corresponding P-MOS transistors corresponding to the same lines in the first switching sub-circuit and the second switching sub-circuit to be in an on state through the power supply control port to supply power to the anodes of the R LEDs and the G/B LEDs of the LED particles in the corresponding lines on the LED display panel 10, and the driving control circuit 353 outputs an R display control signal/G display control signal/B display control signal to each constant current logic component in the first constant current channel group/second constant current channel group/third constant current channel group through the first R display control sub-port/first G display control sub-port/first B display control sub-port to control each constant current logic component in the three constant current channel groups to be in an on working state, thereby providing the current paths for the R cathodes, G cathodes and B cathodes of the LED particles in the corresponding columns and realizing the ordered display of the LED particles.

Based on the technical solution shown in the first transformed implementation mode of embodiments 3 and 4, there may also be a transformed mode as follows:

the LED display panel 10 may also be implemented by an implementation mode as follows: the field effect transistors may be P-MOS transistors, the LED display panel 10 may include M lines and N columns of LED particles, and each LED particle includes an R lamp tube, a G lamp tube and a B lamp tube, wherein the cathode of the R lamp tube in each LED particle in each line is connected in parallel, and is connected with the drain of one corresponding P-MOS transistor in the first switching sub-circuit; the anodes of the G lamp tube and the B lamp tube in each LED particle in each line are connected in parallel, and are connected with the drain of one corresponding P-MOS transistor in the second switching sub-circuit; the cathode of the R lamp tube of each LED particle in each column is connected in parallel, and is connected with the second end of the corresponding constant current logic component in the constant current channel group; the cathode of the G lamp tube of each LED particle in each column is connected in parallel, and is connected with the second end of the corresponding constant current logic component in the constant current channel group; and the cathode of the B lamp tube of each LED particle in each column is connected in parallel, and is connected with the second end of the corresponding constant current logic component in the constant current channel group respectively.

Specifically, the anode of the R lamp tube in each LED particle in each line in the LED display panel 10 is connected in parallel with the drain of one corresponding P-MOS transistor in the first switching sub-circuit; the anodes of the G lamp tube and the B lamp tube in each LED particle in each line are connected in parallel with the drain of one corresponding P-MOS transistor in the second switching sub-circuit; the cathodes of the LEDs in the same basic colors in the LED particles in each column are interconnected to the input ends of the corresponding constant current logic components of the constant current channel group of the display driving circuit 30, that is, the common cathode of the R LEDs in the LED particles in each column is interconnected to the input end of the corresponding constant current logic component of the constant current channel group of the display driving circuit 30; the common cathode of the G LEDs in the LED particles in each column is interconnected to the input end of the corresponding constant current logic component of the constant current channel group of the display driving circuit 30; and the common cathode of the B LEDs in the LED particles in each column is interconnected to the input end of the corresponding constant current logic component of the constant current channel group of the display driving circuit 30.

Based on the technical solution shown in the first transformed implementation mode of embodiments 3 and 4, there may also be two implementation modes as follows:

first: the field effect transistors may also be N-MOS transistors, the LED display panel 10 includes M lines and N columns of LED particles, and each LED particle includes an R lamp tube, a G lamp tube and a B lamp tube, wherein the cathode of the R lamp tube in each LED particle in each line is connected in parallel, and is connected with the drain of the corresponding N-MOS transistor in the first switching sub-circuit; the cathodes of the G lamp tube and the B lamp tube in each LED particle in each line are connected in parallel, and are connected with the drain of the corresponding N-MOS transistor in the second switching sub-circuit; the anode of the R lamp tube of each LED particle in each column is connected in parallel, and is connected with the second end of the corresponding constant current logic component in the constant current channel group; the anode of the G lamp tube of each LED particle in each column is connected in parallel, and is connected with the second end of the corresponding constant current logic component in the constant current channel group; and the anode of the B lamp tube of each LED particle in each column is connected in parallel, and is connected with the second end of the corresponding constant current logic component in the constant current channel group respectively.

Second: the field effect transistors are N-MOS transistors, the LED display panel 10 includes M lines and N columns of LED particles, and each LED particle includes an R lamp tube, a G lamp tube and a B lamp tube, wherein the cathode of the R lamp tube in the ith LED particle in each line is connected in parallel with the ith joint, and each joint in each line is connected in parallel, and is connected with the drain of the corresponding N-MOS transistor in the first switching sub-circuit 31; the cathodes of the G lamp tube and the B lamp tube in the jth LED particle in each line are connected in parallel with the jth joint, and each joint in each line is connected in parallel, and is connected to the drain of the corresponding N-MOS transistor in the second switching sub-circuit 31; the anode of the R lamp tube of each LED particle in each column is connected in parallel, and is connected with the second end of the corresponding constant current logic component in the constant current channel group; the anode of the G lamp tube of each LED particle in each column is connected in parallel, and is connected with the second end of the corresponding constant current logic component in the constant current channel group; and the anode of the B lamp tube of each LED particle in each column is connected in parallel, and is connected with the second end of the corresponding constant current logic component in the constant current channel group respectively.

In the embodiment, the display driving circuit 30 integrates the first switching sub-circuit and the second switching sub-circuit, each of the two switching sub-circuits includes one or more N-MOS transistors, the source of each N-MOS transistor of the first switching sub-circuit may serve as an external pin GND of the display driving circuit, and is connected to a connection terminal of the power end of the power supply equipment, the gate of each N-MOS transistor is connected to an R power supply control signal of the power supply control port, and the drain of each N-MOS transistor is connected to the anodes (i.e. R anodes of the LED particles in the corresponding line) of the R lamp tubes of the LED particles in the corresponding line in the LED display panel 10; and the source of each N-MOS transistor of the second switching sub-circuit is interconnected as an external pin GND of the display driving circuit 30, and is connected to a connection terminal of the power end of the power supply equipment, the gate of each N-MOS transistor is connected to G and B power supply control signals of the power supply control port, and the drain of each N-MOS transistor is connected to the anodes (i.e. G anodes and B anodes of the LED particles in the corresponding line) of the G lamp tubes and B lamp tubes of the LED particles in the corresponding line in the LED display panel 10.

The driving circuit 33 may be the same as that shown in embodiment 1, and may include a constant current channel group, wherein the constant current channel group includes multiple constant current logic components (which may also be called constant current logic circuits); and the second end (i.e. input end) of each constant current logic component serves as one of input pins of the display driving circuit 30, the first ends (i.e. output ends) of all the constant current logic components are internally interconnected, and are connected to the VCC end of the display driving circuit 30, and the third ends (i.e. control ends) of the constant current logic components are connected with the driving control port of the control circuit 35, and are configured to receive a constant current control signal of the driving circuit 33.

Specifically, in the first implementation mode of the transformed mode, the cathode of the R lamp tube of the ith LED particle in each line is connected to the ith joint, and each joint in each line is connected in parallel, and is connected to the drain of the corresponding N-MOS transistor in the first switching sub-circuit; the cathodes of the G lamp tube and the B lamp tube in the jth LED particle in each line are connected in parallel with the jth joint, and each joint in each line is connected in parallel, and is connected with the drain of the corresponding N-MOS transistor in the second switching sub-circuit; the common anode of the R LEDs in the LED particles in each column is interconnected to the input end of the corresponding constant current logic component of the constant current channel group; the common anode of the G LEDs in the LED particles in each column is interconnected to the input end of the corresponding constant current logic component of the constant current channel group; and the common anode of the B LEDs in the LED particles in each column is interconnected to the input end of the corresponding constant current logic component of the constant current channel group.

In the second implementation mode, the cathode of the R lamp tube in each LED particle in each line is internally interconnected, and is connected with the drain of the corresponding N-MOS transistor in the first switching sub-circuit, and the cathodes of the G and B lamp tubes in each LED particle in each line are interconnected, and are connected with the drain of the corresponding N-MOS transistor in the second switching sub-circuit; the common anode of the R LEDs in the LED particles in each column is interconnected, and is connected to the input end of the corresponding constant current logic component of the constant current channel group of the display driving circuit 30; the common anode of the G LEDs in the LED particles in each column is interconnected, and is connected to the input end of the corresponding constant current logic component of the constant current channel group; and the common anode of the B LEDs in the LED particles in each column is interconnected, and is connected to the input end of the constant current logic component of the constant current channel group.

Embodiments 5 and 6

Specifically, a switching circuit 31 of a display driving circuit 30 includes a first switching sub-circuit and a second switching sub-circuit, and a driving circuit 33 includes a first constant current channel group, a second constant current channel group and a third constant current channel group, wherein structures of the first switching sub-circuit and the second switching sub-circuit may be the same as those in the first implementation mode in embodiment 1; the first constant current channel group may include one or more constant current logic components, a first end of each constant current logic component is connected with a power end or grounding end of power supply equipment, a third end of each constant current logic component is connected with a first R display control sub-port of a driving control port, and a second end of each constant current logic component is connected with an anode or cathode of an R lamp tube in each LED particle in a corresponding column in an LED display panel 10, and is configured to control the display of the R lamp tubes of the LED display panel 10; the second constant current channel group includes one or more constant current logic components, a first end of each constant current logic component is connected with the power end or grounding end of the power supply equipment, a third end of each constant current logic component is connected with a first G display control sub-port of the driving control port, and a second end of each constant current logic component is connected with an anode or cathode of a G lamp tube in each LED particle in the corresponding column in the LED display panel 10, and is configured to control the display of the G lamp tubes of the LED display panel 10; and the third constant current channel group includes one or more constant current logic components, a first end of each constant current logic component is connected with the power end or grounding end of the power supply equipment, a third end of each constant current logic component is connected with a first B display control sub-port of the driving control port, and a second end of each constant current logic component is connected with an anode or cathode of a B lamp tube in each LED particle in the corresponding column in the LED display panel 10, and is configured to control the display of the B lamp tubes of the LED display panel 10. Wherein, the first constant current channel group may be an R constant current channel group, the second constant current channel group may be G constant current channel group, and the third constant current channel group may be a B constant current channel group.

Specifically, a power supply control circuit 351 in the control circuit 35 is configured to control a field effect transistor in the first switching sub-circuit to be switched on to supply power to the R lamp tubes in the LED particles in the line corresponding to the field effect transistor in the first switching sub-circuit in the LED display panel 10; the power supply control circuit 351 is further configured to control the field effect transistor corresponding to each field effect transistor in the first switching sub-circuit in the second switching sub-circuit to be switched on to supply power to the G lamp tubes and the B lamp tubes in the LED particles in the line corresponding to the field effect transistor in the first switching sub-circuit in the LED display panel 10; the driving control circuit 353 is configured to control each constant current logic component in the first constant current channel group to be switched on through the first R display control sub-port, and each constant current logic component provides a current path for the R lamp tubes in the LED particles in the column corresponding to the constant current logic component in the LED display panel 10 to control the display of the LED particles in the line corresponding to the field effect transistor in the LED display panel 10 after being switched on; the driving control circuit 353 is further configured to control each constant current logic component in the second constant current channel group to be switched on through the first G display control sub-port, and each constant current logic component provides a current path for the G lamp tubes in the LED particles in the column corresponding to the constant current logic component in the LED display panel 10 to control the display of the G lamp tubes of the LED particles in the line corresponding to the field effect transistor in the LED display panel 10 after being switched on; and the driving control circuit 353 is further configured to control each constant current logic component in the third constant current channel group to be switched on through the first B display control sub-port, and each constant current logic component provides a current path for the B lamp tubes in the LED particles in the column corresponding to the constant current logic component in the LED display panel 10 to control the display of the B lamp tubes of the LED particles in the line corresponding to the field effect transistor in the LED display panel 10 respectively after being switched on.

Wherein, the three constant current channel groups in the embodiment control the constant current display of the R lamp tubes, the G lamp tubes and the B lamp tubes (which may be R/G/B LEDs) on the LED display panel 10 respectively, the first switching sub-circuit 31 and the second switching sub-circuit 31 (each of the two switching sub-circuits 31 may be a group of channels, called P-MOS channels for short, consisting of P-MOS transistors) in the switching circuit 31 are configured to control the power supply of the R/G/B LEDs on the LED display panel 10 respectively, and the power supply control circuit 351 and the driving control circuit 353 in the display driving circuit 30 control working states of the switching circuit 31 and the driving circuit 33 respectively.

Correspondingly, the power supply control port includes a first power supply control port and a second power supply control port, wherein the first power supply control port is configured to transmit a first power supply control signal to the first switching sub-circuit (i.e. VCCB-powered P-MOS channel group shown in FIG. 9), and the second power supply control port is configured to transmit a second power supply control signal to the second switching sub-circuit (i.e. VCCA-powered P-MOS channel group); and the driving control port includes a second R/G/B display control sub-port which transmits second R/G/B display control signals to the R/G/B constant current channel groups.

Figure 9A:
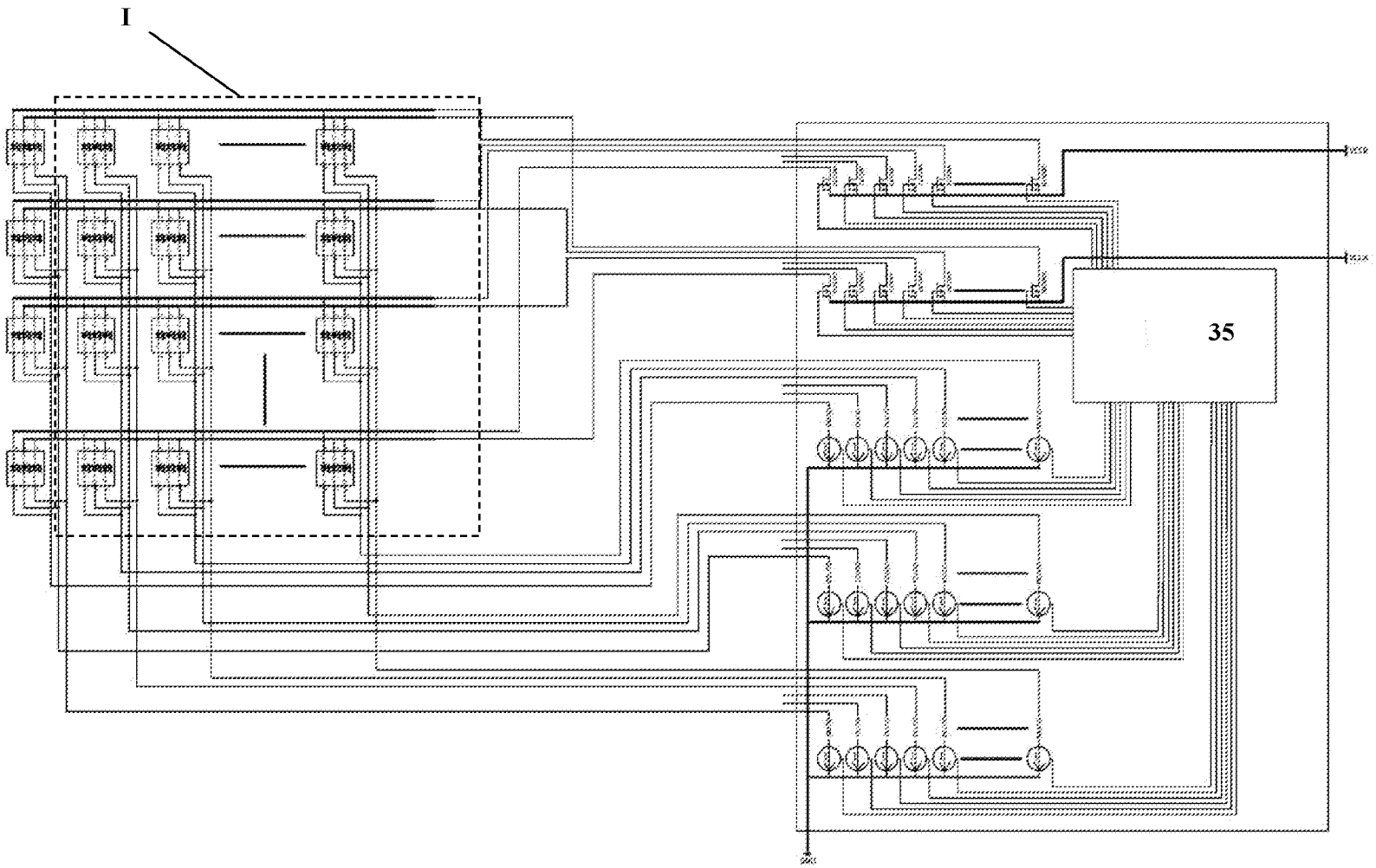
FIG. 9*a* is a structure diagram of an LED display according to embodiment 5 of the disclosure.
Figure 9B:
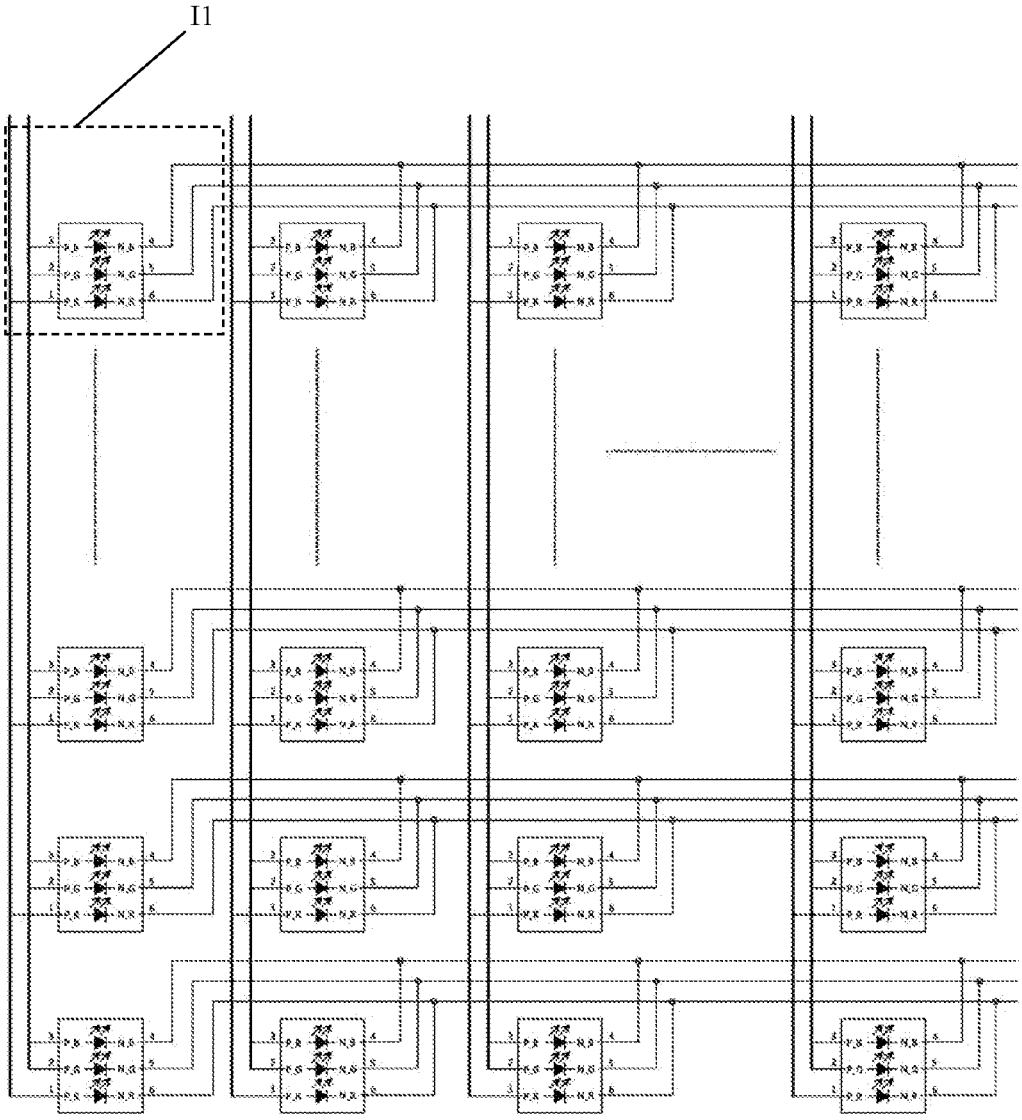
FIG. 9*b* is a drawing of partial enlargement of a dotted part I in FIG. 9*a;*
Figure 9C:
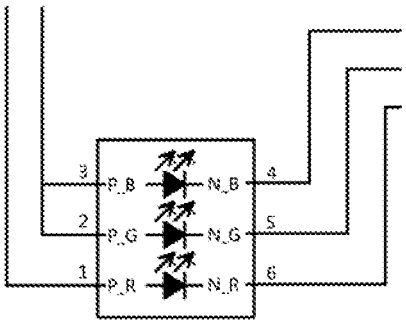
FIG. 9*c* is a drawing of partial enlargement of a dotted part I1 in FIG. 9*b;*
Figure 10A:
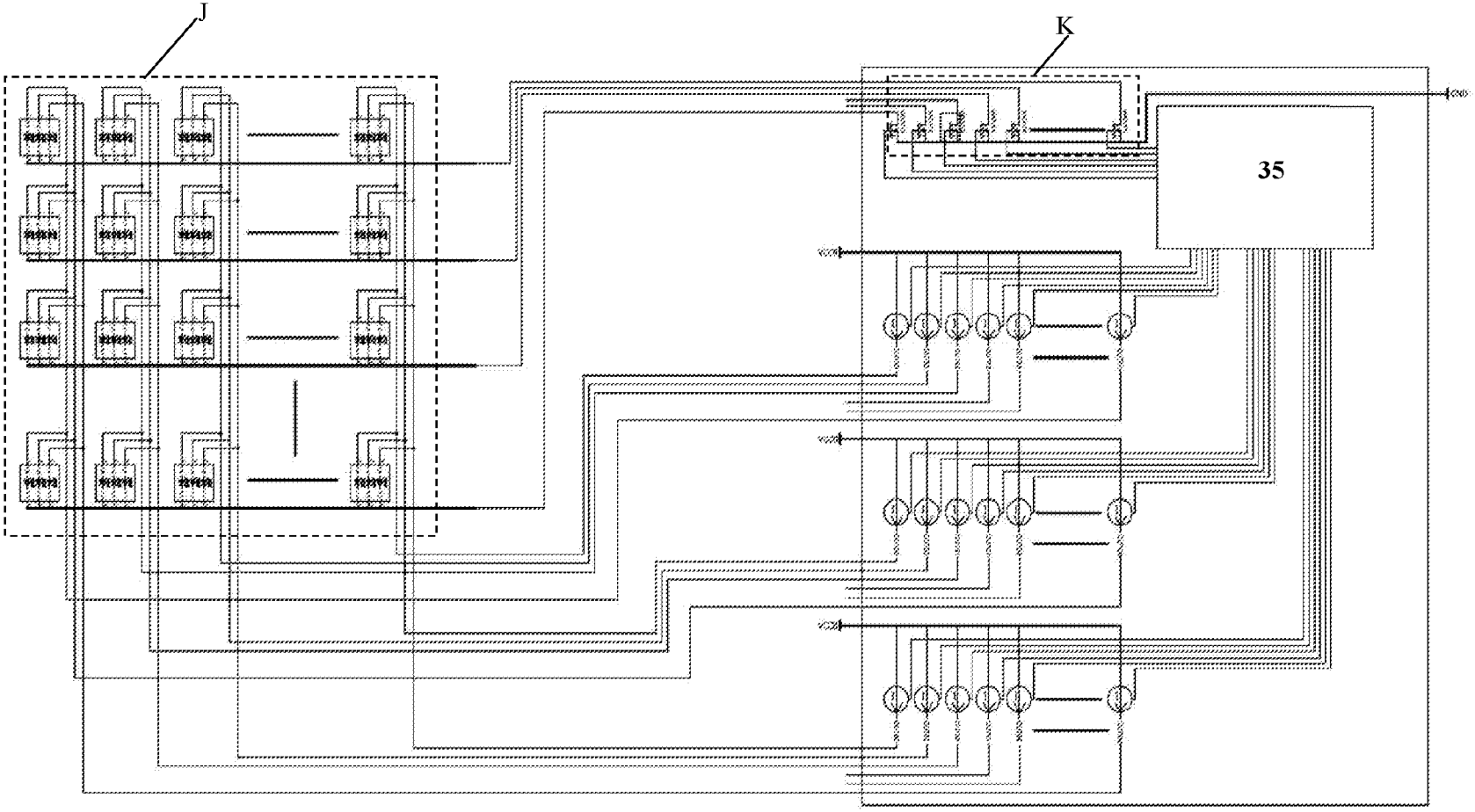
FIG. 10*a* is a structure diagram of an LED display according to embodiment 6 of the disclosure.
Figure 10B:
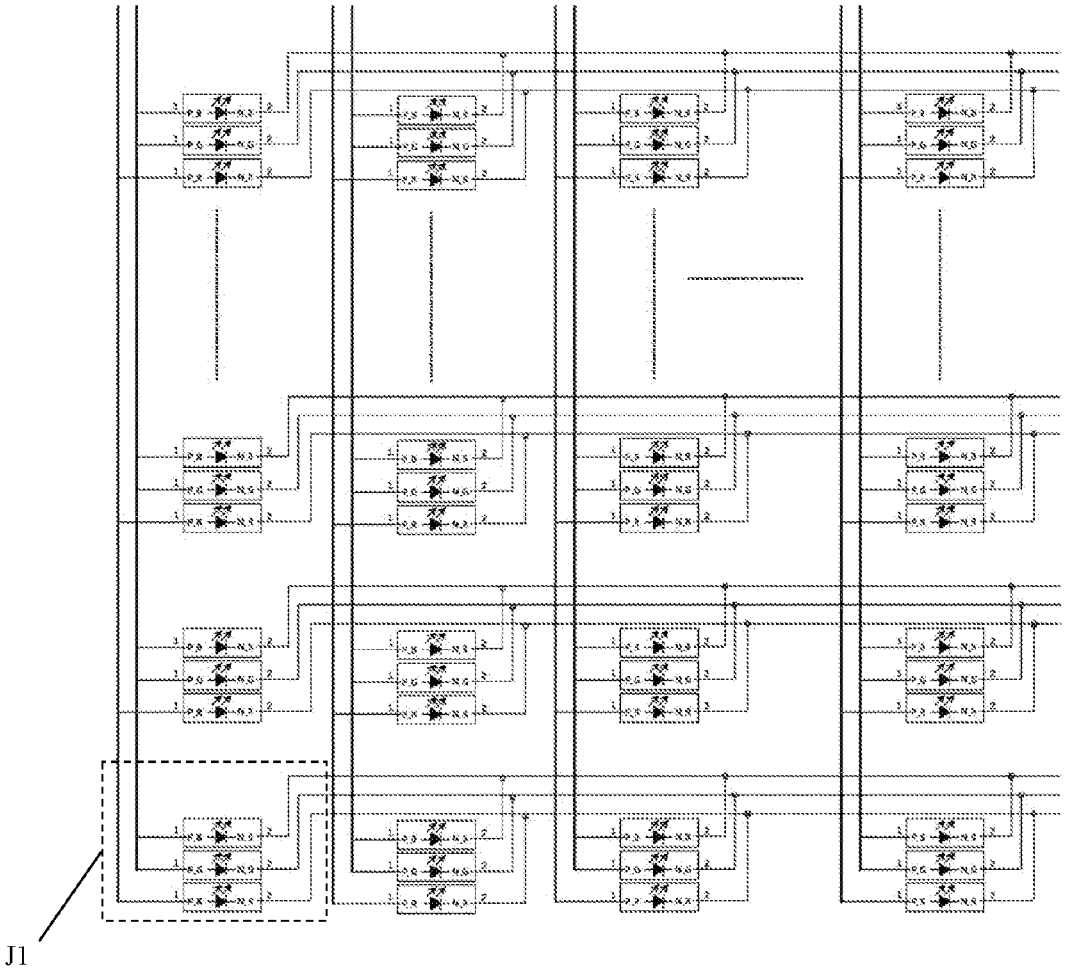
FIG. 10*b* is a drawing of partial enlargement of a dotted part J in FIG. 10*a;*
Figure 10C:
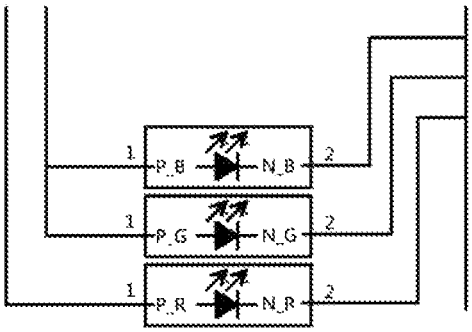
FIG. 10*c* is a drawing of partial enlargement of a dotted part J1 in FIG. 10*b;*

FIG. 9*a* to FIG. 9*c* are structure diagrams of an LED display according to embodiment 7 of the disclosure, and FIG. 10*a* to FIG. 10*e* are structure diagrams of an LED display according to embodiment 7 of the disclosure. FIG. 9*b* and FIG. 10*b* show drawings of partial enlargement of a part I covered by a dotted line in FIG. 9*a* and a part J covered by a dotted line in FIG. 10*a* in the two embodiments respectively, LEDs in three basic colors in an LED particle in FIG. 9*c* are directly integrated on the LED particle, the LEDs in the three basic colors in each LED particle in FIG. 10*c* are encapsulated and integrated on the LED particle respectively, but beyond that, the same circuit connection relationship may be adopted in the two implementation modes. Wherein, the anode of each LED particle in FIG. 9*c* and FIG. 9*b* has three pins, i.e. 1, 2 and 3 respectively, corresponding to the anodes of the internal R/G/B LEDs respectively, and the cathode of each LED particle in FIG. 9*c* and FIG. 9*b* has three pins, i.e. 4, 5 and 6 respectively, corresponding to the cathodes of the internal R/G/B LEDs respectively; and as shown in FIG. 10*c*, the anodes of the R/G/B LEDs are pins 1, the cathodes of the R/G/B LEDs are pins 2, and the R/G/B LEDs are welded in parallel as the LED particles (i.e. full-color pixels).

Specifically, the display driving circuit 30 integrates three constant current channel groups which control the constant current display of the R/G/B LEDs on the LED display panel 10 respectively, integrates two groups of P-MOS channels which are configured to control the power supply of the R/G/B LEDs on the LED display panel 10 respectively, and integrates the control circuit 35 which is configured to control the coordinated work of the constant current channel groups and the P-MOS transistor channels.

Figure 10D:
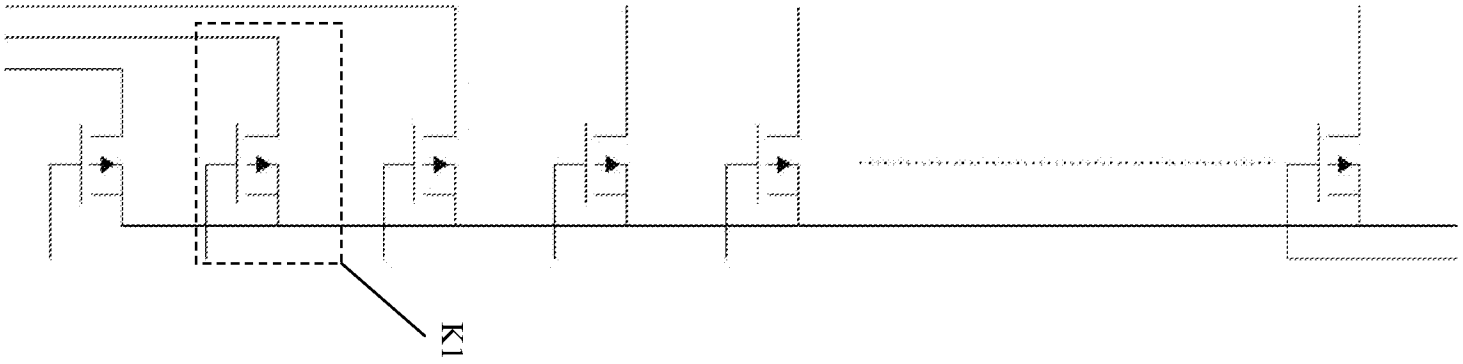
FIG. 10*d* is a drawing of partial enlargement of a dotted part K in FIG. 10*a;*
Figure 10E:
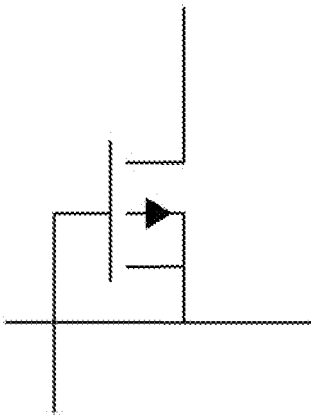
FIG. 10*e* is a drawing of partial enlargement of a dotted part K1 in FIG. 10*d*.

In embodiments 5 and 6, the field effect transistors on the part K covered by the dotted line in FIG. 10*a* may be P-MOS transistors, FIG. 10*e* shows the structure of the P-MOS transistor on the part K1 covered by the dotted line in FIG. 10*d*, the LED display panel 10 includes M lines and N columns of LED particles, and each LED particle includes an R lamp tube, a G lamp tube and a B lamp tube, wherein the anode of the R lamp tube in each LED particle in each line is connected in parallel, and is connected with the drain of one corresponding P-MOS transistor in the first switching sub-circuit; the anodes of the G lamp tube and the B lamp tube in each LED particle in each line are connected in parallel, and are connected with the drain of one corresponding P-MOS transistor in the second switching sub-circuit as connection terminals of the anode of the LED display panel 10; the cathode of the R lamp tube of each LED particle in each column is connected in parallel, and is connected with the second end of the corresponding constant current logic component in the first constant current channel group; the cathode of the G lamp tube of each LED particle in each column is connected in parallel, and is connected with the second end of the corresponding constant current logic component in the second constant current channel group; and the cathode of the B lamp tube of each LED particle in each column is connected in parallel, and is connected with the second end of the corresponding constant current logic component in the third constant current channel group respectively.

The first switching sub-circuit includes one or more P-MOS transistors, the sources of these P-MOS transistors are interconnected to an external pin VCCB of the display driving circuit 30 (3024), the gates of the P-MOS transistors are connected to the first power supply control port, and the drains of the P-MOS transistors are connected to the R anodes of the LED particles in the corresponding lines in the LED display panel 10 (the LED particles in a single line or in multiple lines in FIG. 9*a*); and the second switching sub-circuit includes one or more P-MOS transistors, the sources of these P-MOS transistors are interconnected to an external pin VCCA of the display driving circuit 30 (3024), the gates of the P-MOS transistors are connected to the second power supply control port, and the drains of the P-MOS transistors are connected to the G and B anodes of the LED particles in the corresponding lines in the LED display panel 10 (the LED particles in a single line or in multiple lines in FIG. 9*a*).

In addition, the R constant current channel group may include one or more constant current logic components, the input ends of these constant current logic components are connected to the R cathodes of the LED particles in the corresponding columns in the LED display panel 10, the output ends of the constant current logic components are interconnected to the external pin GND of the display driving circuit 30, and the control ends of the constant current logic components are connected to the first R display control sub-port; the G constant current channel group may include one or more constant current logic components, the input ends of these constant current logic components are connected to the G cathodes of the LED particles in the corresponding columns in the LED display panel 10, the output ends of the constant current logic components are interconnected to the external pin GND of the display driving circuit 30, and the control ends of the constant current logic components are connected to the first G display control sub-port; and the B constant current channel group may include one or more constant current logic components, the input ends of these constant current logic components are connected to the B cathodes of the LED particles in the corresponding columns in the LED display panel 10, the output ends of the constant current logic components are interconnected to the external pin GND of the display driving circuit 30, and the control ends of the constant current logic components are connected to the first B display control sub-port.

Under the control of the display driving circuit 30, the power supply control circuit 351 controls the corresponding two P-MOS transistors corresponding to the same line in the first switching sub-circuit 31 and the second switching sub-circuit 31 to be in an on state through the power supply control port to supply power to the anodes of the R LEDs and the G/B LEDs of the LED particles in the corresponding line on the LED display panel 10, and the driving control circuit 353 outputs an R display control signal/G display control signal/B display control signal to each constant current logic component in the first constant current channel group/second constant current channel group/third constant current channel group through the second R display control sub-port/second G display control sub-port/second B display control sub-port to control each constant current logic component in the three constant current channel groups to be in an on working state, thereby providing the current paths for the R cathodes, G cathodes and B cathodes of the LED particles in the corresponding columns and realizing the ordered display of the LED particles.

In the implementation mode, power supply voltages of the first switching sub-circuit and the second switching sub-circuit may be different, a power supply voltage of VCCB is preferably 1.6V, and may be lower than that of the pin VCCA, and 1.6V is obtained by subtracting a typical working voltage (1.8-2V) of the R lamp tubes from typical working voltages (3.4-3.6V) of the G and B lamp tubes, so that the power supply voltages of the R/G/B LEDs may be differentially controlled to further reduce the power consumption of the LED display.

In addition, the implementation modes shown in embodiments 5 and 6 may also be transformed as follows:

the field effect transistors in the LED display may be P-MOS transistors, the LED display panel 10 may include M lines and N columns of LED particles, and each LED particle includes an R lamp tube, a G lamp tube and a B lamp tube, wherein the anode of the R lamp tube in the ith LED particle in each line is connected in parallel with the ith joint, and each joint in each line is connected in parallel, and is connected with the drain of one corresponding P-MOS transistor in the first switching sub-circuit 31; the anodes of the G lamp tube and the B lamp tube in the jth LED particle in each line are connected in parallel with the jth joint, and each joint in each line is connected in parallel, and is connected with the drain of one corresponding P-MOS transistor in the second switching sub-circuit 31; the cathode of the R lamp tube of each LED particle in each column is connected in parallel, and is connected with the second end of the corresponding constant current logic component in the first constant current channel group; the cathode of the G lamp tube of each LED particle in each column is connected in parallel, and is connected with the second end of the corresponding constant current logic component in the second constant current channel group respectively; and the cathode of the B lamp tube of each LED particle in each column is connected in parallel, and is connected with the second end of the corresponding constant current logic component in the third constant current channel group.

Furthermore, the power supply voltage of the external pin VCCB of the display driving circuit 30 may be lower than that of the external pin VCCA, and is preferably 1.6V which is obtained by subtracting the typical working voltage (1.8-2V) of the R lamp tubes from the working voltages (3.4-3.6V) of the G and B lamp tubes, and the power supply voltages of the R/G/B LEDs are differentially controlled, thereby reducing the power consumption of the LED display.

Based on the implementation modes shown in embodiments 5 and 6, there may also be two transformations as follows:

the field effect transistors may also be N-MOS transistors, the LED display panel 10 includes M lines and N columns of LED particles, and each LED particle includes an R lamp tube, a G lamp tube and a B lamp tube, wherein the cathode of the R lamp tube in the ith LED particle in each line is connected in parallel with the ith joint, and each joint in each line is connected in parallel, and is connected with the drain of the corresponding N-MOS transistor in the first switching sub-circuit 31; the cathodes of the G lamp tube and the B lamp tube in the jth LED particle in each line are connected in parallel with the jth joint, and each joint in each line is connected in parallel, and is connected with the drain of the corresponding N-MOS transistor in the second switching sub-circuit 31; the anode of the R lamp tube of each LED particle in each column is connected in parallel, and is connected with the second end of the corresponding constant current logic component in the first constant current channel group; the anode of the G lamp tube of each LED particle in each column is connected in parallel, and is connected with the second end of the corresponding constant current logic component in the second constant current channel group; and the anode of the B lamp tube of each LED particle in each column is connected in parallel, and is connected with the second end of the corresponding constant current logic component in the third constant current channel group.

Specifically, in the embodiment, the first switching sub-circuit includes one or more N-MOS transistors, the sources of these N-MOS transistors are interconnected to the external pin GND of the display driving circuit 30, the gates of the N-MOS transistors are connected to the first power supply control port, and the drains of the N-MOS transistors are connected to the R anodes of the LED particles in the corresponding lines in the LED display panel 10 (the LED particles in a single line or in multiple lines in FIG. 10*a*); and the second switching sub-circuit includes one or more N-MOS transistors, the sources of these N-MOS transistors are interconnected to the external pin GND of the display driving circuit 30, the gates of the N-MOS transistors are connected to the second power supply control port, and the drains of the N-MOS transistors are connected to the G and B anodes of the LED particles in the corresponding lines in the LED display panel 10 (the LED particles in a single line or in multiple lines in FIG. 10*a*).

In addition, the R constant current channel group may include one or more constant current logic components, the input ends of these constant current logic components are connected to the R cathodes of the LED particles in the corresponding columns in the LED display panel 10, the output ends of the constant current logic components are interconnected to the external pin VCCR of the display driving circuit 30, and the control ends of the constant current logic components are connected to the first R display control sub-port; the G constant current channel group may include one or more constant current logic components, the input ends of these constant current logic components are connected to the G cathodes of the LED particles in the corresponding columns in the LED display panel 10, the output ends of the constant current logic components are interconnected to the external pin VCCG of the display driving circuit 30, and the control ends of the constant current logic components are connected to the first G display control sub-port; and the B constant current channel group may include one or more constant current logic components, the input ends of these constant current logic components are connected to the B cathodes of the LED particles in the corresponding columns in the LED display panel 10, the output ends of the constant current logic components are interconnected to the external pin VCCB of the display driving circuit 30, and the control ends of the constant current logic components are connected to the first B display control sub-port.

Wherein, the power supply voltage of the external pin VCCR is lower than that of the external pin VCCR/VCCB, and is preferably 1.6V which is obtained by subtracting the typical working voltage (1.8-2V) of the R lamp tubes from the typical working voltages (3.4-3.6V) of the G and B lamp tubes, and the power supply voltages of the R/G/B LEDs are differentially controlled, thereby reducing the power consumption of the LED display.

Specifically, the cathode of the R lamp tube in the ith LED particle in each line is connected in parallel with the ith joint, and each joint in each line is connected in parallel, and is connected with the drain of the corresponding N-MOS transistor in the first switching sub-circuit 31 respectively; the cathodes of the G lamp tube and the B lamp tube in the jth LED particle in each line are connected in parallel with the jth joint, and each joint in each line is connected in parallel, and is connected with the drain of the corresponding N-MOS transistor in the second switching sub-circuit 31; the common anode of the R LEDs in the LED particles in each column is interconnected to the input end of the corresponding constant current logic component of the first constant current channel group of the display driving circuit 30; the common anode of the G LEDs of the LED particles in each column is interconnected to the input end of the constant current logic component of the second constant current channel group of the display driving circuit 30; and the common anode of the B LEDs of the LED particles in each column is interconnected to the input end of the corresponding constant current logic component of the third constant current channel group of the display driving circuit 30.

In addition, embodiment 8 may be implemented by a method as follows: the field effect transistors may be N-MOS transistors, the LED display panel 10 includes M lines and N columns of LED particles, and each LED particle includes an R lamp tube, a G lamp tube and a B lamp tube, wherein the cathode of the R lamp tube in each LED particle in each line is connected in parallel, and is connected with the drain of the corresponding N-MOS transistor in the first switching sub-circuit 31; the cathodes of the G lamp tube and the B lamp tube in each LED particle in each line are connected in parallel, and are connected with the drain of the corresponding N-MOS transistor in the second switching sub-circuit 31; the anode of the R lamp tube of each LED particle in each column is connected in parallel, and is connected with the second end of the corresponding constant current logic component in the first constant current channel group; the anode of the G lamp tube of each LED particle in each column is connected in parallel, and is connected with the second end of the corresponding constant current logic component in the second constant current channel group; and the anode of the B lamp tube of each LED particle in each column is connected in parallel, and is connected with the second end of the corresponding constant current logic component in the third constant current channel group respectively.

Specifically, the cathode of the R lamp tube in each LED particle in each line is internally interconnected, and is connected with the drain of the corresponding N-MOS transistor in the first switching sub-circuit 31, and the cathodes of the G and B lamp tubes in each LED particle in each line are interconnected, and are connected with the drain of the corresponding N-MOS transistor in the second switching sub-circuit 31 respectively; the common anode of the R LEDs in the LED particles in each column is interconnected, and is connected to the input end of the corresponding constant current logic component of the constant current channel group of the display driving circuit 30; the common anode of the G LEDs in the LED particles in each column is interconnected, and is connected to the input end of the corresponding constant current logic component of the constant current channel group of the display driving circuit 30; and the common anode of the B LEDs in the LED particles in each column is interconnected, and is connected to the input end of the constant current logic component of the constant current channel group of the display driving circuit 30.

The LED particles in the LED display according to the embodiment of the disclosure include the R lamp tubes, the G lamp tubes and the B lamp tubes, wherein the R lamp tubes, the G lamp tubes and the B lamp tubes may be integrated in the LED particles, and may also be arranged in the LED particles after being independently encapsulated respectively.

In embodiments 1 to 6, the field effect transistors in FIG. 6*a*, FIG. 7*a* and FIG. 8*a* may be the N-MOS transistors shown in FIG. 7*c* respectively, and the field effect transistors in FIG. 5*a*, FIG. 9*a* and FIG. 10*a* may be the P-MOS transistors shown in FIG. 10*c* respectively.

Figure 11:
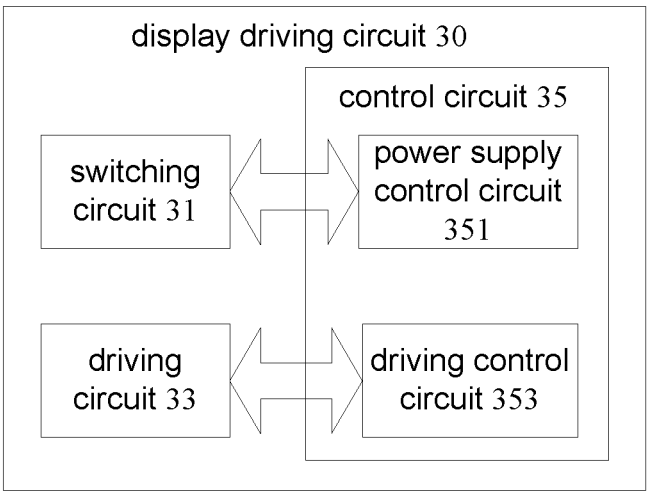
FIG. 11 is a structure diagram of an LED control system according to an embodiment of the disclosure.

FIG. 11 is a structure diagram of an LED control system according to an embodiment of the disclosure. As shown in FIG. 11, the LED control system includes: a display driving circuit 30, the display driving circuit 30 includes a switching circuit 31, a driving circuit 33 and a control circuit 35, wherein a first end of one of the switching circuit 31 and the driving circuit 33 is connected to a power end of power supply equipment, and a first end of the other of the switching circuit 31 and the driving circuit 33 is connected to a grounding end of the power supply equipment; a second end of one of the switching circuit 31 and the driving circuit 33 is connected with an anode of an LED display panel 10, and a second end of the other of the switching circuit 31 and the driving circuit 33 is connected to a cathode of the LED display panel 10; the switching circuit 31 is configured to control the power supply of the LED display panel 10, and the driving circuit 33 is configured to control the ordered display of the LED display panel 10; the control circuit includes: a power supply control circuit 351 and a driving control circuit 353; the power supply control circuit 351 is connected with a third end of the switching circuit 31 through a power supply control port, and is configured to control the switching-on or switching-off of the switching circuit 31; and the driving control circuit 353 is connected with a third end of the driving circuit 33 through a driving control port, and is configured to control the switching-on or switching-off of the driving circuit 33.

According to the disclosure, the display driving circuit 30 in the LED control system includes the switching circuit 31, the driving circuit 33 and the control circuit 35, wherein the control circuit 35 includes the power supply control circuit 351 and the driving control circuit 353; the power supply control circuit 351 is configured to control the switching-on or switching-off of the switching circuit 31; and the driving control circuit 353 is configured to control the switching-on or switching-off of the driving circuit 33, then control the power supply of the LED display panel 10 by switching on or switching off the switching circuit 31 and control the display of the LED display panel 10 by switching on or switching off the driving circuit 33, thereby realizing the ordered display of the LED display panel 10. By the LED control system of the disclosure, the switching circuit 31, the driving circuit 33 and the control circuit 35 are integrated in the display driving circuit 30, and then more display driving circuits 30 may be placed under the condition of not changing an area of the LED display panel 10, so that a number ratio of the LED particles and the display driving circuits 30 on the LED display with a fixed area is reduced, and a refresh rate is increased; moreover, a connection relationship between the LED particle array with M lines and N columns in the LED display panel and the display driving circuits 30 is clearer, and fewer connection lines are required, so that the design difficulty of a PCB is lowered. The problems of large PCB area occupied by the control circuit 35, low refresh rate and high power consumption of the LED display in related art are solved, and the effects of small PCB area occupied by the control circuit 35, simple design and high refresh rate of the LED display are achieved.

From the above, it may be seen that the disclosure achieves technical effects as follows: by the LED display and the LED control system of the disclosure, the switching circuit 31, the driving circuit 33 and the control circuit 35 are integrated in the display driving circuit 30, and then more display driving circuits 30 may be placed under the condition of not changing the area of the LED display panel 10, so that the number ratio of the LED particles and the display driving circuits 30 on the LED display with the fixed area is reduced, and the refresh rate is increased; moreover, a connection relationship between the LED particle array with M lines and N columns in the LED display panel and the display driving circuits 30 is clearer, and fewer connection lines are required, so that the design difficulty of the PCB is lowered. The problems of large PCB area occupied by the control circuit 35, low refresh rate and high power consumption of the LED display in related art are solved, and the effects of small PCB area occupied by the control circuit 35, simple design and high refresh rate of the LED display are achieved.

The above is only the preferred embodiment of the disclosure and not intended to limit the disclosure. For those skilled in the art, the disclosure may have various modifications and variations. Any modifications, equivalent replacements, improvements and the like within the spirit and principle of the disclosure shall fall within the scope of protection of the disclosure.

What is claimed is:

1. A Light-Emitting Diode (LED) display, comprising:

an LED display panel; and a display driving circuit, comprises a switching circuit and a control circuit, wherein the switching circuit comprises a first switching sub-circuit and a second switching sub-circuit;

the first switching sub-circuit comprises one or more field effect transistors, a source of each field effect transistor is connected with a power end of first power supply equipment, a drain of each field effect transistor is connected with an anode of a Red (R) lamp tube in each LED particle in a corresponding line in the LED display panel, and a gate of each field effect transistor is connected with a corresponding connection terminal in a power supply control port, and is configured to control power supply of the corresponding R lamp tube of the LED display panel;

the second switching sub-circuit comprises one or more field effect transistors, a source of each field effect transistor is connected with a power end of second power supply equipment, a drain of each field effect transistor is connected with anodes of Green/Blue (G/B) lamp tubes in each LED particle in a corresponding line in the LED display panel, and a gate of each field effect transistor is connected with a corresponding connection terminal in the power supply control port, and is configured to control power supply of the G/B lamp tubes of the LED display panel;

the control circuit comprises a power supply control circuit; the power supply control circuit is connected with a third end of the switching circuit through the power supply control port, and is configured to control the switching-on or switching-off of the switching circuit; and the switching circuit is configured to control power supply of the LED display panel, wherein the power supply control circuit is configured to control each field effect transistor in the first switching sub-circuit to be switched on to supply power to the R lamp tubes in the LED particles in the lines corresponding to the field effect transistors in the first switching sub-circuit in the LED display panel; and the power supply control circuit is further configured to control the field effect transistor corresponding to one field effect transistor in the first switching sub-circuit and in the second switching sub-circuit to be switched on to supply power to the G/B lamp tubes in each LED particle in the line corresponding to the field effect transistor in the first switching sub-circuit in the LED display panel; and wherein the display driving circuit further comprises: a driving circuit, a first end of the driving circuit is connected to a grounding end of power supply equipment, and a second end of the driving circuit is connected with a cathode of the LED display panel;

the control circuit further comprises: a driving control circuit, the driving control circuit is connected with a third end of the driving circuit through a driving control port, and is configured to control switching-on or switching-off of the driving circuit; and the driving circuit is configured to control ordered display of the LED display panel.

2. The display according to claim 1, wherein the driving circuit comprises a constant current channel group, and the constant current channel group comprises one or more constant current logic components;

a first end of each constant current logic component is connected with the grounding end of the power supply equipment;

a second end of each constant current logic component is connected with cathodes of the LED particles in a corresponding column in the LED display panel; and a third end of each constant current logic component is connected with a corresponding connection terminal in the driving control port.

3. The display according to claim 2, wherein the driving control circuit is configured to control each constant current logic component in the constant current channel group to be switched on, and each constant current logic component provides a current path for the LED particles in the column corresponding to the constant current logic component in the LED display panel to control ordered display of the LED particles after being switched on.

4. The display according to claim 2, wherein the field effect transistors are P-MOS transistors, the LED display panel comprises M lines and N columns of the LED particles, and each LED particle comprises the R lamp tube, the G lamp tube and the B lamp tube;

an anode of the R lamp tube in an ith LED particle in each line is connected in parallel with an ith joint, and each joint in each line is connected in parallel, and is connected with the drain of one corresponding P-MOS transistor in the first switching sub-circuit;

an anode of the G lamp tube and an anode of the B lamp tube in a jth LED particle in each line are connected in parallel with a jth joint, and each joint in each line is connected in parallel, and is connected with a drain of one corresponding P-MOS transistor in the second switching sub-circuit;

a cathode of the R lamp tube of each LED particle in each column is connected in parallel, and is connected with a second end of one corresponding constant current logic component in the constant current channel group;

a cathode of the G lamp tube of each LED particle in each column is connected in parallel, and is connected with the second end of one corresponding constant current logic component in the constant current channel group; and a cathode of the B lamp tube of each LED particle in each column is connected in parallel, and is connected with the second end of one corresponding constant current logic component in the constant current channel group.

5. The display according to claim 2, wherein the field effect transistors are P-MOS transistors, the LED display panel comprises M lines and N columns of LED particles, and each LED particle comprises the R lamp tube, the G lamp tube and the B lamp tube;

the anode of the R lamp tube of each LED particle in each line is connected in parallel, and is connected with the drain of one corresponding P-MOS transistor in the first switching sub-circuit;

the anode of the G lamp tube and the anode of the B lamp tube in each LED particle in each line are connected in parallel, and are connected with the drain of one corresponding P-MOS transistor in the second switching sub-circuit;

the cathode of the R lamp tube of each LED particle in each column is connected in parallel, and is connected with the second end of one corresponding constant current logic component in the constant current channel group;

the cathode of the G lamp tube of each LED particle in each column is connected in parallel, and is connected with the second end of one corresponding constant current logic component in the constant current channel group; and the cathode of the B lamp tube of each LED particle in each column is connected in parallel, and is connected with the second end of one corresponding constant current logic component in the constant current channel group.

6. The display according to claim 1, wherein the driving circuit comprises a first constant current channel group, a second constant current channel group and a third constant current channel group;

the first constant current channel group comprises one or more constant current logic components, a first end of each constant current logic component is connected with the grounding end of the power supply equipment, a third end of each constant current logic component is connected with a first R display control sub-port of the driving control port, and a second end of each constant current logic component is connected with the cathode of the R lamp tube in each LED particle in the corresponding column in the LED display panel, and is configured to control display of the R lamp tubes of the LED display panel;

the second constant current channel group comprises one or more constant current logic components, a first end of each constant current logic component is connected with the grounding end of the power supply equipment, a third end of each constant current logic component is connected with a first G display control sub-port of the driving control port, and a second end of each constant current logic component is connected with the cathode of the G lamp tube in each LED particle in the corresponding column in the LED display panel, and is configured to control display of the G lamp tubes of the LED display panel; and the third constant current channel group comprises one or more constant current logic components, a first end of each constant current logic component is connected with the grounding end of the power supply equipment, a third end of each constant current logic component is connected with a first B display control sub-port of the driving control port, and a second end of each constant current logic component is connected with the cathode of the B lamp tube in each LED particle in the corresponding column in the LED display panel, and is configured to control display of the B lamp tubes of the LED display panel.

7. The display according to claim 6, wherein the power supply control circuit is configured to control one field effect transistor in the first switching sub-circuit to be switched on to supply power to the R lamp tubes in the LED particles in the line corresponding to the field effect transistor in the first switching sub-circuit in the LED display panel;

the power supply control circuit is further configured to control the field effect transistor corresponding to the switched-on field effect transistor in the first switching sub-circuit in the second switching sub-circuit to be switched on to supply power to the G lamp tubes and the b lamp tubes in the LED particles in the line corresponding to the field effect transistor in the first switching sub-circuit in the LED display panel;

the driving control circuit is configured to control each constant current logic component in the first constant current channel group to be switched on through a second R display control sub-port, and each constant current logic component provides a current path for the R lamp tubes in the LED particles in the column corresponding to the constant current logic component in the LED display panel to control display of the R lamp tubes of the LED particles in the line corresponding to the field effect transistor in the LED display panel after being switched on;

the driving control circuit is further configured to control each constant current logic component in the second constant current channel group to be switched on through a second G display control sub-port, and each constant current logic component provides a current path for the G lamp tubes in the LED particles in the column corresponding to the constant current logic component in the LED display panel to control display of the G lamp tubes of the LED particles in the line corresponding to the field effect transistor in the LED display panel after being switched on; and the driving control circuit is further configured to control each constant current logic component in the third constant current channel group to be switched on through a second B display control sub-port, and each constant current logic component provides a current path for the B lamp tubes in the LED particles in the column corresponding to the constant current logic component in the LED display panel to control display of the B lamp tubes of the LED particles in the line corresponding to the field effect transistor in the LED display panel after being switched on.

8. The display according to claim 6, wherein the field effect transistors are P-MOS transistors, the LED display panel comprises M lines and N columns of LED particles, and each LED particle comprises the R lamp tube, the G lamp tube and the B lamp tube;

the anode of the R lamp tube in the ith LED particle in each line is connected in parallel with the ith joint, and each joint in each line is connected in parallel, and is connected with the drain of one corresponding P-MOS transistor in the first switching sub-circuit;

the anode of the G lamp tube and the anode of the B lamp tube in the jth LED particle in each line are connected in parallel with the jth joint, and each joint in each line is connected in parallel, and is connected with the drain of one corresponding P-MOS transistor in the second switching sub-circuit;

the cathode of the R lamp tube of each LED particle in each column is connected in parallel, and is connected with the second end of the corresponding constant current logic component in the first constant current channel group;

the cathode of the G lamp tube of each LED particle in each column is connected in parallel, and is connected with the second end of the corresponding constant current logic component in the second constant current channel group; and the cathode of the B lamp tube of each LED particle in each column is connected in parallel, and is connected with the second end of the corresponding constant current logic component in the third constant current channel group.

9. The display according to claim 6, wherein the field effect transistors are P-MOS transistors, the LED display panel comprises M lines and N columns of LED particles, and each LED particle comprises the R lamp tube, the G lamp tube and the B lamp tube respectively;

the anode of the R lamp tube in each LED particle in each line is connected in parallel, and is connected with the drain of one corresponding P-MOS transistor in the first switching sub-circuit respectively;

the anode of the G lamp tube and the anode of the B lamp tube in each LED particle in each line are connected in parallel, and are connected with the drain of one corresponding P-MOS transistor in the second switching sub-circuit as connection terminals of the anode of the LED display panel respectively;

the cathode of the R lamp tube of each LED particle in each column is connected in parallel, and is connected with the second end of the corresponding constant current logic component in the first constant current channel group respectively;

the cathode of the G lamp tube of each LED particle in each column is connected in parallel, and is connected with the second end of the corresponding constant current logic component in the second constant current channel group respectively; and the cathode of the B lamp tube of each LED particle in each column is connected in parallel, and is connected with the second end of the corresponding constant current logic component in the third constant current channel group respectively.

10. The display according to claim 1, wherein the LED particles in the LED display panel comprise the R lamp tubes, the G lamp tubes and the B lamp tubes;

the R lamp tubes, the G lamp tubes and the B lamp tubes are integrated in the LED particles; or the R lamp tubes, the G lamp tubes and the B lamp tubes are arranged in the LED particles after being independently encapsulated respectively.

11. The display according to claim 3, wherein the field effect transistors are P-MOS transistors, the LED display panel comprises M lines and N columns of the LED particles, and each LED particle comprises the R lamp tube, the G lamp tube and the B lamp tube;

an anode of the R lamp tube in an ith LED particle in each line is connected in parallel with an ith joint, and each joint in each line is connected in parallel, and is connected with the drain of one corresponding P-MOS transistor in the first switching sub-circuit;

an anode of the G lamp tube and an anode of the B lamp tube in a jth LED particle in each line are connected in parallel with a jth joint, and each joint in each line is connected in parallel, and is connected with a drain of one corresponding P-MOS transistor in the second switching sub-circuit;

a cathode of the R lamp tube of each LED particle in each column is connected in parallel, and is connected with a second end of one corresponding constant current logic component in the constant current channel group;

a cathode of the G lamp tube of each LED particle in each column is connected in parallel, and is connected with the second end of one corresponding constant current logic component in the constant current channel group; and a cathode of the B lamp tube of each LED particle in each column is connected in parallel, and is connected with the second end of one corresponding constant current logic component in the constant current channel group.

12. The display according to claim 3, wherein the field effect transistors are P-MOS transistors, the LED display panel comprises M lines and N columns of LED particles, and each LED particle comprises the R lamp tube, the G lamp tube and the B lamp tube;

the anode of the R lamp tube of each LED particle in each line is connected in parallel, and is connected with the drain of one corresponding P-MOS transistor in the first switching sub-circuit;

the anode of the G lamp tube and the anode of the B lamp tube in each LED particle in each line are connected in parallel, and are connected with the drain of one corresponding P-MOS transistor in the second switching sub-circuit;

the cathode of the R lamp tube of each LED particle in each column is connected in parallel, and is connected with the second end of one corresponding constant current logic component in the constant current channel group;

the cathode of the G lamp tube of each LED particle in each column is connected in parallel, and is connected with the second end of one corresponding constant current logic component in the constant current channel group; and the cathode of the B lamp tube of each LED particle in each column is connected in parallel, and is connected with the second end of one corresponding constant current logic component in the constant current channel group.

13. The display according to claim 7, wherein the field effect transistors are P-MOS transistors, the LED display panel comprises M lines and N columns of LED particles, and each LED particle comprises the R lamp tube, the G lamp tube and the B lamp tube;

the anode of the R lamp tube in the ith LED particle in each line is connected in parallel with the ith joint, and each joint in each line is connected in parallel, and is connected with the drain of one corresponding P-MOS transistor in the first switching sub-circuit;

the anode of the G lamp tube and the anode of the B lamp tube in the jth LED particle in each line are connected in parallel with the jth joint, and each joint in each line is connected in parallel, and is connected with the drain of one corresponding P-MOS transistor in the second switching sub-circuit;

the cathode of the R lamp tube of each LED particle in each column is connected in parallel, and is connected with the second end of the corresponding constant current logic component in the first constant current channel group;

the cathode of the G lamp tube of each LED particle in each column is connected in parallel, and is connected with the second end of the corresponding constant current logic component in the second constant current channel group; and the cathode of the B lamp tube of each LED particle in each column is connected in parallel, and is connected with the second end of the corresponding constant current logic component in the third constant current channel group.

14. The display according to claim 7, wherein the field effect transistors are P-MOS transistors, the LED display panel comprises M lines and N columns of LED particles, and each LED particle comprises the R lamp tube, the G lamp tube and the B lamp tube respectively;

the anode of the R lamp tube in each LED particle in each line is connected in parallel, and is connected with the drain of one corresponding P-MOS transistor in the first switching sub-circuit respectively;

the anode of the G lamp tube and the anode of the B lamp tube in each LED particle in each line are connected in parallel, and are connected with the drain of one corresponding P-MOS transistor in the second switching sub-circuit as connection terminals of the anode of the LED display panel respectively;

the cathode of the R lamp tube of each LED particle in each column is connected in parallel, and is connected with the second end of the corresponding constant current logic component in the first constant current channel group respectively;

the cathode of the G lamp tube of each LED particle in each column is connected in parallel, and is connected with the second end of the corresponding constant current logic component in the second constant current channel group respectively; and the cathode of the B lamp tube of each LED particle in each column is connected in parallel, and is connected with the second end of the corresponding constant current logic component in the third constant current channel group respectively.

* * * * *